US009212527B2

(12) United States Patent
Heidecke et al.

(10) Patent No.: US 9,212,527 B2
(45) Date of Patent: Dec. 15, 2015

(54) PIPE HANDLING SYSTEM

(71) Applicant: Weatherford/Lamb, Inc., Houston, TX (US)

(72) Inventors: Karsten Heidecke, Houston, TX (US); Michael Hayes, Houston, TX (US); Frederick T. Tilton, Spring, TX (US); Doyle Fredric Boutwell, Jr., Houston, TX (US); Robert P. Badrak, Sugar Land, TX (US); Joseph Ross Rials, Tomball, TX (US); David J. Havens, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 14/486,669

(22) Filed: Sep. 15, 2014

(65) Prior Publication Data

US 2015/0060045 A1 Mar. 5, 2015

Related U.S. Application Data

(63) Continuation of application No. 12/713,067, filed on Feb. 25, 2010, now Pat. No. 8,833,470.

(60) Provisional application No. 61/208,589, filed on Feb. 25, 2009.

(51) Int. Cl.
*E21B 19/16* (2006.01)

(52) U.S. Cl.
CPC ..... *E21B 19/16* (2013.01)

(58) Field of Classification Search
CPC ..... E21B 19/16
See application file for complete search history.

(56) References Cited

U.S. PATENT DOCUMENTS

| | | | |
|---|---|---|---|
| 2,167,338 | A | 7/1939 | Murcell |
| 5,071,053 | A | 12/1991 | Heijnen |
| 6,078,031 | A | 6/2000 | Bliault et al. |
| 6,288,373 | B1 | 9/2001 | Jahn et al. |
| 6,612,184 | B1 | 9/2003 | Hollingsworth et al. |
| 6,796,390 | B1 | 9/2004 | Bakker |
| 6,896,171 | B2 | 5/2005 | Den Boer et al. |
| 6,935,429 | B2 | 8/2005 | Badrak |

(Continued)

FOREIGN PATENT DOCUMENTS

| | | | |
|---|---|---|---|
| EP | 0105892 | A1 | 4/1984 |
| EP | 1534466 | A1 | 6/2005 |
| GB | 2340859 | A | 3/2000 |
| WO | 99/30000 | A1 | 6/1999 |
| WO | 0230608 | A1 | 4/2002 |

OTHER PUBLICATIONS

Office Action; Canadian Patent Application No. 2,753,573; Dated Oct. 23, 2012.

(Continued)

*Primary Examiner* — David Andrews
(74) *Attorney, Agent, or Firm* — Patterson & Sheridan, LLP

(57) ABSTRACT

A pipe handling system for locating a pipe joint in a joining assembly that includes an internal joining tool and an external joining tool is provided. The system includes a gripper configured to grip a surface of the pipe joint; an elevator configured to pick up the pipe joint and position the pipe joint adjacent a string of pipe disposed in the external joining tool; and a deployment assembly coupled to the gripper, wherein the deployment assembly includes a cable that is used to position the internal joining tool inside the pipe joint.

20 Claims, 44 Drawing Sheets

(56) References Cited

U.S. PATENT DOCUMENTS

| | | | |
|---|---|---|---|
| 6,935,430 | B2 | 8/2005 | Harrall et al. |
| 6,997,264 | B2 | 2/2006 | Simpson et al. |
| 7,100,697 | B2 | 9/2006 | Haugen et al. |
| 7,150,328 | B2 | 12/2006 | Marketz et al. |
| 7,152,657 | B2 | 12/2006 | Bosma et al. |
| 7,168,606 | B2 | 1/2007 | Badrak |
| 7,181,821 | B2 | 2/2007 | Anderson et al. |
| 7,199,325 | B2 | 4/2007 | Alford et al. |
| 7,282,663 | B2 | 10/2007 | Alford et al. |
| 7,474,221 | B2 | 1/2009 | Den Boer et al. |
| 7,640,965 | B2 | 1/2010 | Bosma et al. |
| 7,774,917 | B2 | 8/2010 | Anderson et al. |
| 2004/0251050 | A1 | 12/2004 | Shahin et al. |
| 2006/0169752 | A1 | 8/2006 | Den Boer et al. |
| 2007/0228753 | A1 * | 10/2007 | Dugal et al. ..... 294/88 |
| 2008/0302539 | A1 | 12/2008 | Mallenahalli et al. |

OTHER PUBLICATIONS

Australian Patent Examination Report No. 1 dated Dec. 5, 2012, Australian Application No. 2010217897.

Australian Patent Examination Report No. 2 dated May 6, 2013, Australian Application No. 2010217897.

Australian Patent Examination Report No. 3 dated Jan. 22, 2014, Australian Application No. 2010217897.

* cited by examiner

100

100

300

400

PIPE HANDLING SYSTEM

CROSS-REFERENCE TO RELATED APPLICATIONS

This application claims benefit of U.S. patent application Ser. No. 12/713,067, filed Feb. 25, 2010, which claims benefit of provisional patent application Ser. No. 61/208,589, filed Feb. 25, 2009, which are herein incorporated by reference.

BACKGROUND OF THE INVENTION

1. Field of the Invention

Embodiments of the present invention generally relate to apparatus and methods for handling pipe. More particularly, embodiments of the invention relate to a pipe handling system for use with a welding or forging assembly at a wellbore.

2. Description of the Related Art

In order to access hydrocarbons in subsurface formations, it is necessary to drill a borehole into the earth. The process of drilling the borehole and subsequently completing the borehole in order to form a wellbore requires the use of a string of pipe. The string of pipe is formed by connecting several pipe joints together at the wellbore and then the string of pipe is lowered into the wellbore. One method of forming the string of pipe is by using a welding tool to connect the pipe joints together in a welding operation. Although the use of the welding tool is an effective means of forming the string of pipe, it is often difficult to position a pipe joint adjacent another pipe joint during the welding operation. Therefore, a need exists for an apparatus and a method to position pipe joints at the wellbore in order to form the string of pipe during a welding operation.

SUMMARY OF THE INVENTION

The present invention generally relates to a pipe handling system for use with a tubular joining system (such as a welding or forging assembly) located on a drilling rig at a wellbore. In one aspect, a method of forming a string of pipe using a joining assembly at a wellbore is provided. The joining assembly includes an internal joining tool and an external joining tool. The method includes the step of picking up the pipe joint using an elevator. The method further includes the step of positioning a lower end of the pipe joint adjacent an end of a string of pipe disposed in the external joining tool. The method also includes the step of moving the internal joining tool from a first position to a second position relative to the elevator, wherein the second position is between the pipe joint and the string of pipe. The method further includes the step of forming a connection between the pipe joint and the string of pipe. The method further includes the step of gripping the pipe joint with a gripping tool and releasing the elevator from the pipe joint. Additionally, the method includes the step of lowering the pipe joint and the string of pipe into the wellbore.

In another aspect, a method of forming a string of pipe using a joining assembly on a rig is provided. The joining assembly includes an internal joining tool and an external joining tool. The method includes the step of suspending a gripping tool and the internal joining tool from the rig. The method further includes the step of positioning an upper end of a first pipe joint in the external joining tool. The method also includes the step of picking up a second pipe joint and positioning a lower end of the second pipe joint adjacent the upper end of the first pipe joint. The method further includes the step of lowering the internal joining tool through the first pipe joint to a position between the first pipe joint and the second pipe joint. The method further includes the step of joining the pipe joints to form the string of pipe by utilizing the external joining tool and the internal joining tool. The method further includes the step of lowering the gripping tool to grip an internal surface of the string of pipe. The method further includes the step of lowering the string of pipe such that an upper end of the string of pipe is located in the external joining tool. Additionally, the method includes the step of retrieving the gripping tool and the internal joining tool from the string of pipe.

In a further aspect, a pipe handling system for locating a pipe joint in a joining assembly that includes an internal joining tool and an external joining tool is provided. The system includes a gripper configured to grip a surface of the pipe joint. The system further includes an elevator configured to pick up the pipe joint and position the pipe joint adjacent a string of pipe disposed in the external joining tool. Additionally, the system includes a deployment assembly coupled to the gripper, wherein the deployment assembly includes a cable that is used to position the internal joining tool inside the pipe joint.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention relates to a pipe handling system for use with a tubular joining system (such as a welding or forging assembly) located on a drilling rig at a wellbore. In the description that follows, like parts are marked throughout the specification and drawings with the same number indicator. The drawings may be, but are not necessarily to scale, and the proportions of certain parts have been exaggerated to better illustrate details and features of the invention. To better understand the aspects of the present invention and the methods of use thereof, reference is hereafter made to the accompanying drawings.

Figure 1:
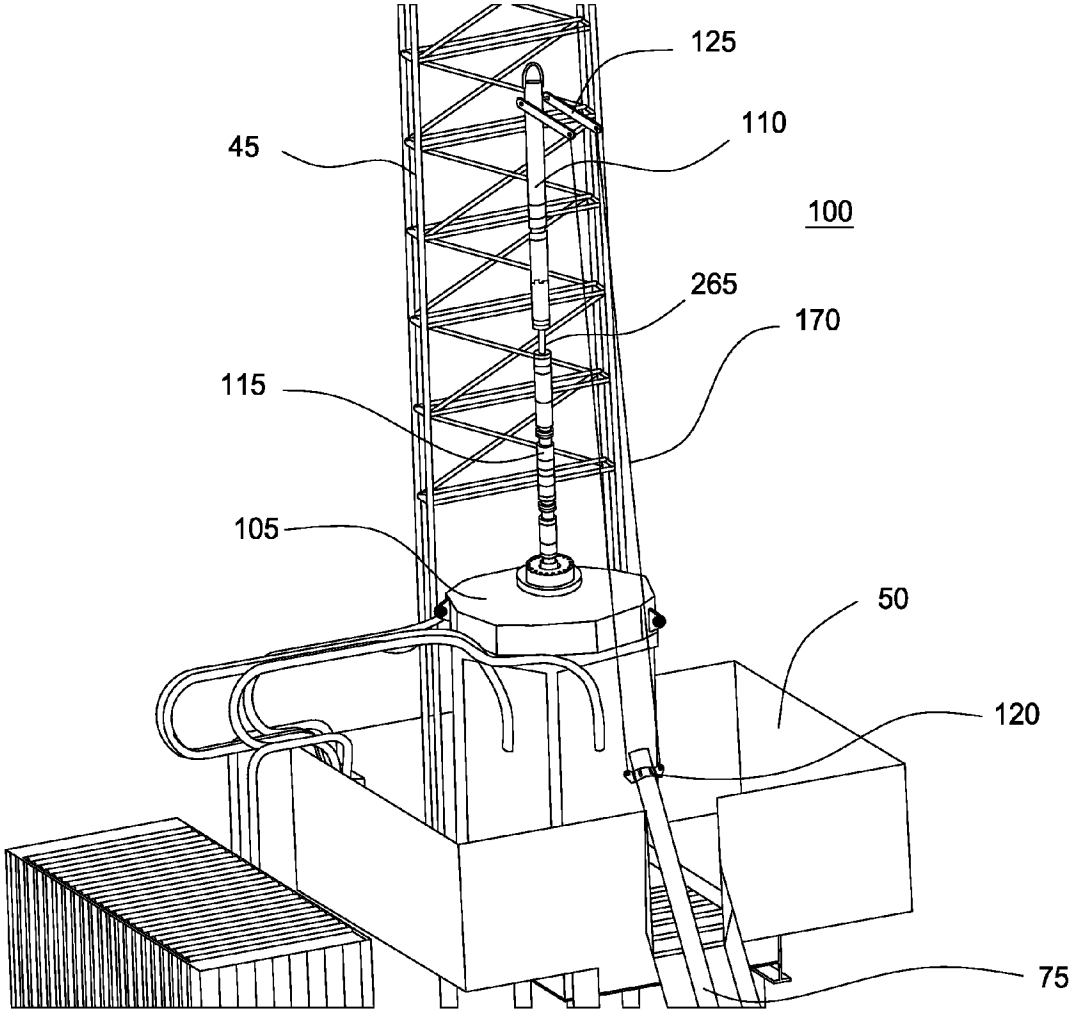
FIG. 1 illustrates a pipe handling system for use with a joining assembly.

FIGS. 1-14 illustrate a pipe handling system 100 for use with a joining (e.g. welding or forging) assembly comprising an internal joining tool 115 and an external joining tool 105. The internal joining tool 115 may be used to grip the pipe joint, seal an annulus in the pipe joint or any other procedure necessary for the joining operation. As shown in FIG. 1, the system 100 includes an internal gripping tool 110, such as a Weatherford TorkDrive™ Compact tool. Suitable internal gripping tools are disclosed in US Patent Application Publication No. 2007/0131416, filed on Dec. 12, 2006, which application is incorporated herein by reference. The internal gripping tool 110 may be directly suspended from a hook attached to a traveling block or connected to a top drive assembly (not shown) attached to a rig 45. Further, the internal gripping tool 110 is configured to hold a pipe joint and position the pipe joint after the joining operation is completed, as will be described herein. Further, a stop facility on the internal gripping tool 110 may be used to permit accurate juxtaposition of the various components in the system 100, such as the pipe joint.

The system 100 includes a link-tilt device 125. The link-tilt device 125 may be used to pivot the link arms out and back as required e.g. by use of an appropriate piston-cylinder arrangement. An elevator 120 is connected to the link-tilt device 125 via cables 170. The cables 170 may be winched up and down to assist with the joining operation. The elevator 120 may include a door arrangement that allows the elevator 120 to pick up pipe from a V-door or a pipe ramp adjacent a drill floor 50. Additionally, the elevator 120 may include slips to hold the weight of each pipe joint and the pipe string after the joining process is complete. The operation of the elevator 120 will be described in relation to FIGS. 15A-15D. The system 100 further includes a winch device 150 (see FIG. 16) attached above the internal gripping tool 110. The winch device 150 includes an umbilical cable 265 that is connected to the internal joining tool 115. As will be described herein, the umbilical cable 265 is used to move the internal joining tool 115 between a parked position and a weld position. The umbilical cable 265 is also used to supply the power to the internal joining tool 115. The system 100 may include a spider (not shown) on the drill floor 50 or positioned in a rotary table. The spider is configured to handle the pipe and hold the string of pipe while the next pipe is being joined. If the pipe joints are large diameter, the internal gripping tool 110 may be large enough so that the parked position of the internal joining tool 115 is at least partially inside the internal gripping tool 110.

Figure 3:
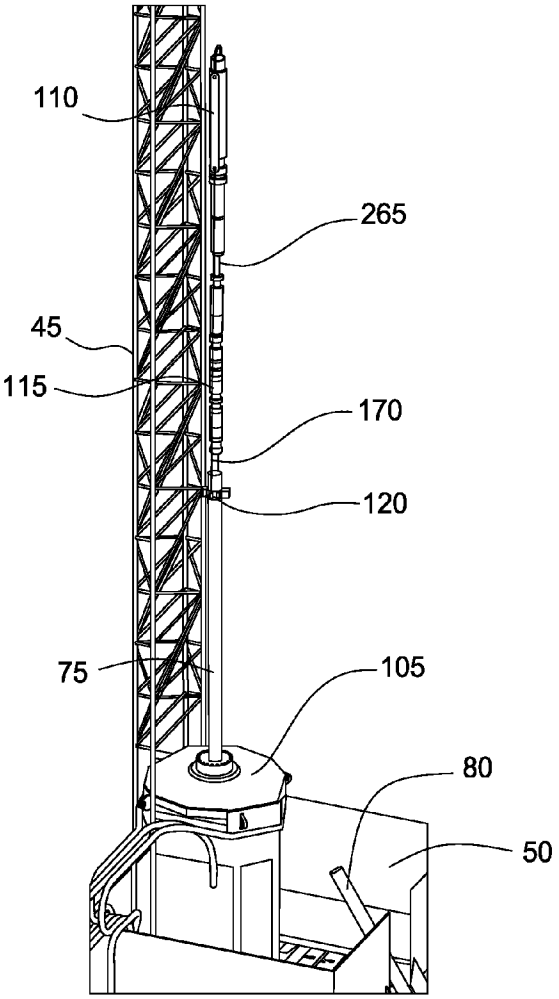
FIG. 3 illustrates the lowering a portion of the pipe joint into the joining assembly.
Figure 2:
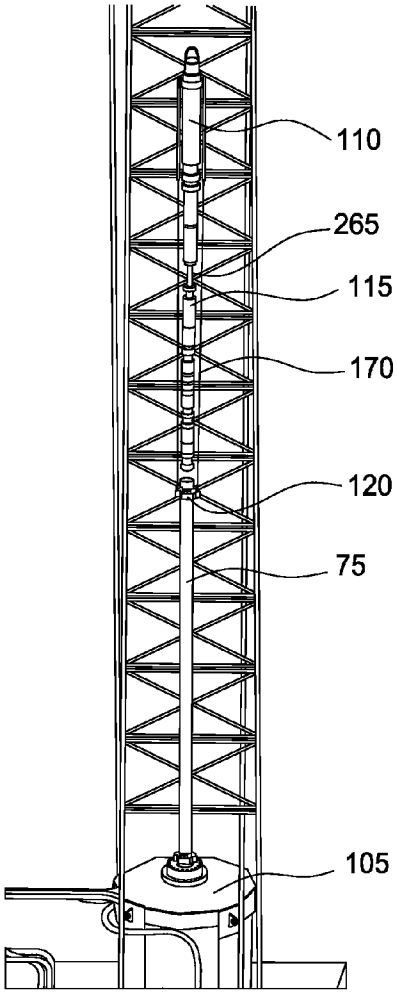
FIG. 2 illustrates the positioning of a pipe joint relative to the joining assembly.
Figure 4:
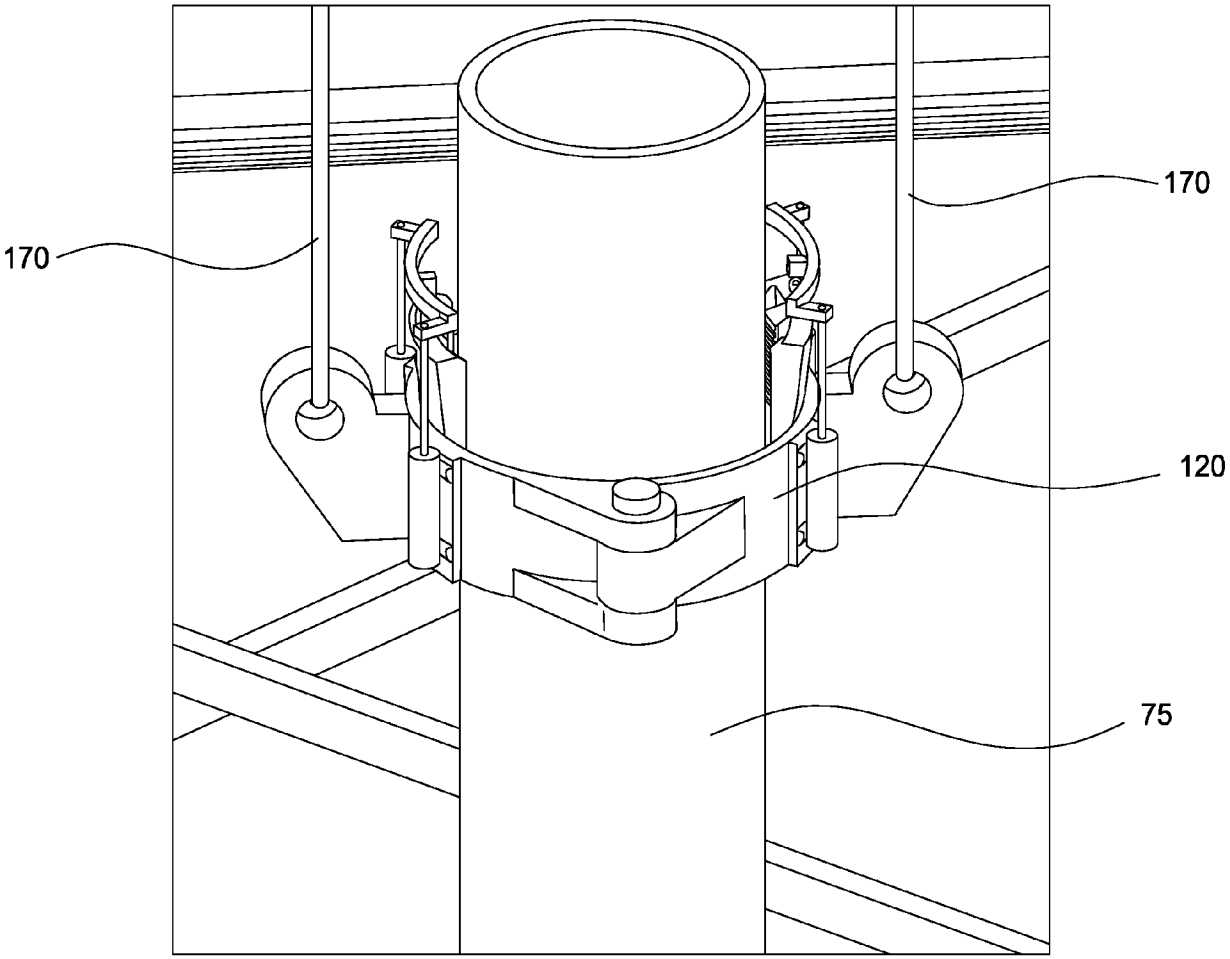
FIG. 4 illustrates the release of an elevator from the pipe joint.

As shown in FIG. 1, the elevator 120 is lowered toward the drill floor 50 and positioned adjacent a pipe joint 75 by utilizing the link-tilt device 125. It is to be noted that the pipe joint 75 is the first pipe joint to be lowered into the wellbore. As will be described herein, other pipe joints will be attached to the pipe joint 75 during the joining operation to form a string of pipe. In one embodiment, the ends of the pipe joints have been pre-flared prior to engagement with the elevator 120. As also shown in FIG. 1, the winch device 150 has positioned the internal joining tool 115 in the parked position. After the elevator 120 is disposed around the pipe joint 75, the slips in the elevator 120 are set so that the elevator 120 can support the weight of the pipe joint 75. FIG. 2 illustrates the elevator 120 supporting the pipe joint 75 after the pipe joint 75 has been lifted from the V-door. Additionally, the pipe joint 75 is positioned such that an end of the pipe joint 75 is located near an opening of the external joining tool 105. FIG. 3 illustrates the lowering of the pipe joint 75 into the external joining tool 105. The pipe joint 75 is lowered until the lower end of the pipe joint 75 is positioned within the spider on the drill floor 50, and then the spider is activated. At this point, the pipe joint 75 is supported by the spider, and therefore the elevator 120 may be released from the pipe joint as shown in FIG. 4.

Figure 6:
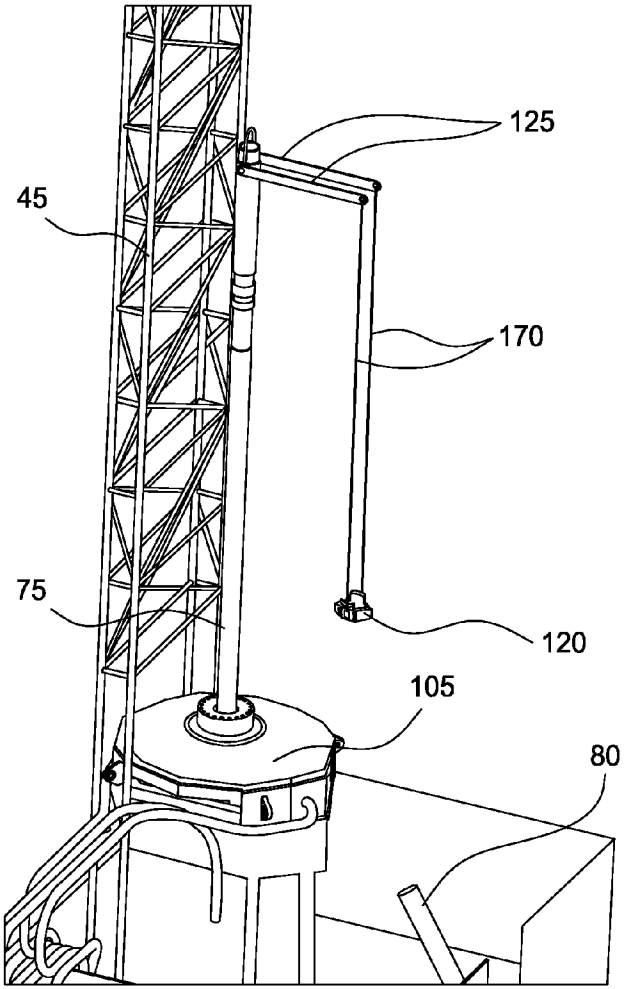
FIG. 6 illustrates the positioning of the elevator in the pipe handling system.
Figure 5:
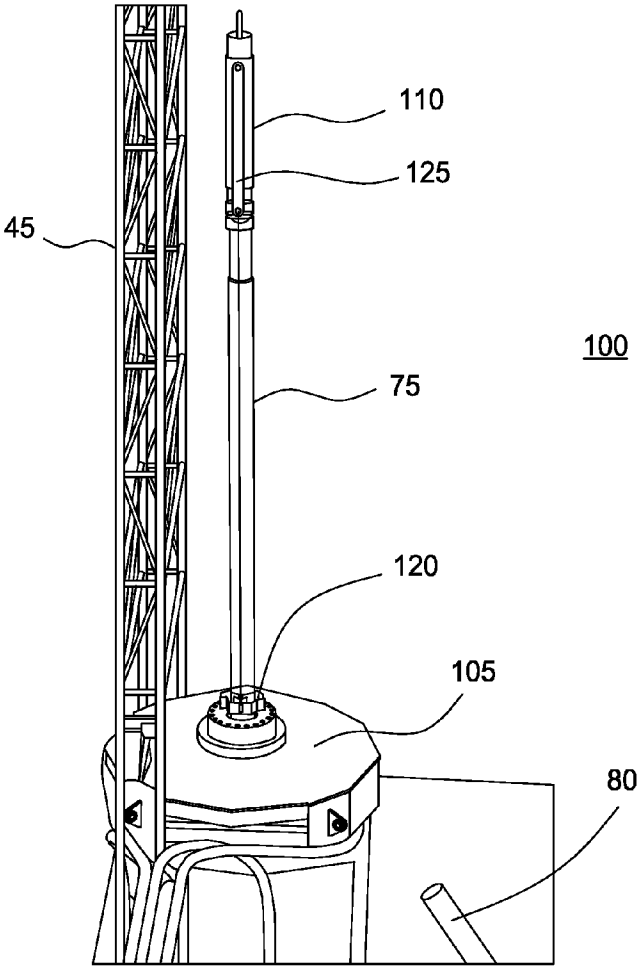
FIG. 5 illustrates an internal gripping tool gripping an end of the pipe joint.

FIG. 5 illustrates the positioning of the internal gripping tool 110 within the pipe joint 75. Generally, the internal gripping tool 110 is lowered until it is positioned in the upper end of the pipe joint 75. In one embodiment, the internal gripping tool 110 includes a stop member that is configured to position the pipe joint 75 in the correct location for the engagement. Thereafter, the gripping elements 195 such as slips (see FIG. 16) of the internal gripping tool 110 are activated. With the internal gripping tool 110 engaged, the internal gripping tool 110 can take the weight of the pipe joint 75 so the spider can be opened. As also shown in FIG. 5, the elevator 120 has been moved down the pipe joint 75. FIG. 6 illustrates the positioning of the elevator 120. After the internal gripping tool 110 has engaged with the pipe joint 75, the link-tilt device 125 is activated to move the elevator 120 away from the pipe joint 75 and toward another pipe joint 80.

Figure 7:
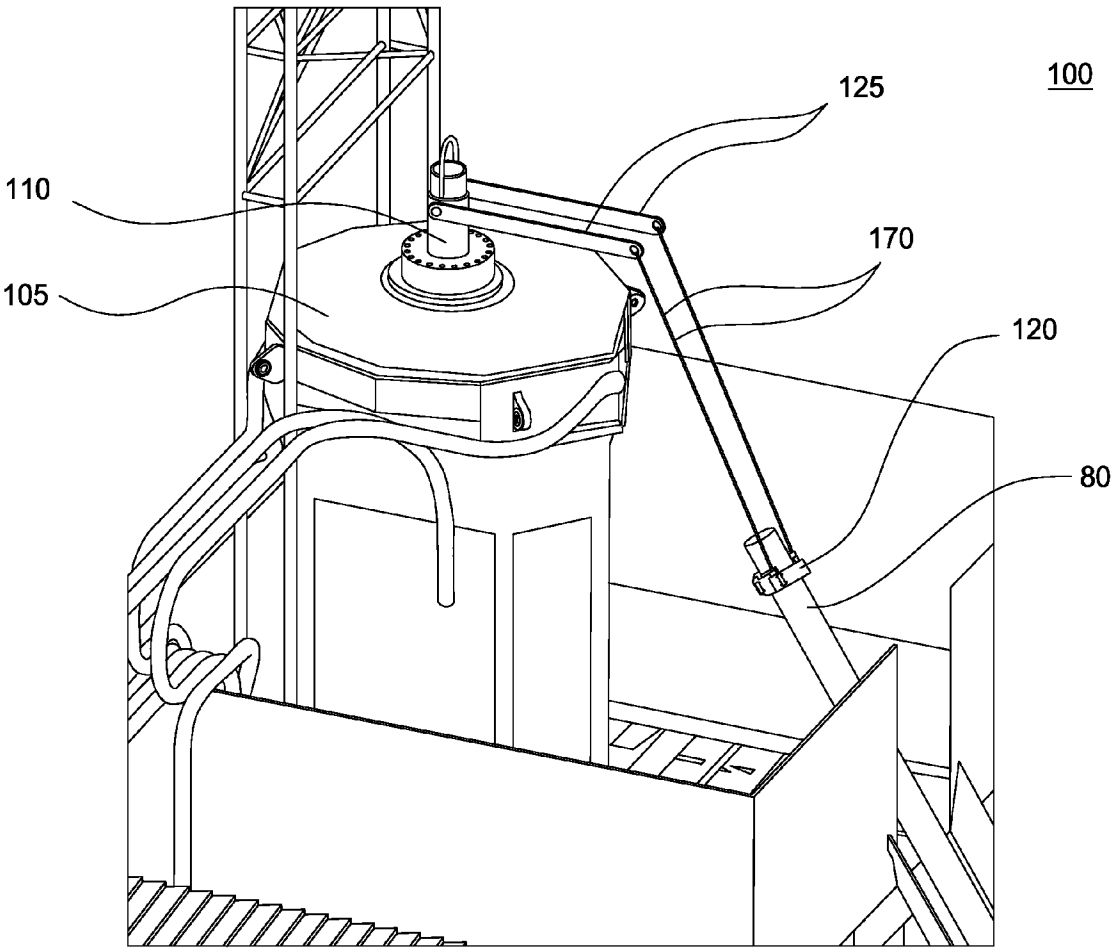
FIG. 7 illustrates the positioning of an end of the pipe joint in the joining assembly.

FIG. 7 illustrates the positioning of an upper end of the pipe joint 75 in the external joining tool 105. As shown in FIG. 7, the internal gripping tool 110 lowers the pipe joint 75 into the external joining tool 105 until the upper end of the pipe joint 75 is in a connection position within the external joining tool 105. Generally, the connection position is a predetermined location in the external joining tool 105 that allows the upper end of the pipe joint 75 to be positioned such that another pipe joint (not shown) can be connected to the pipe joint 75 during a joining operation. In one embodiment, the connection position may be achieved by a physical stop between the internal gripping tool 110 and a top of the external joining tool 105. In another embodiment, the connection position may be achieved by sensors that generate data regarding the position of the upper end of the pipe joint 75 and the data is used by a control member that controls the movement of the internal gripping tool 110. In a further embodiment, the connection position may be achieved by a controller that moves the internal gripping tool 110 based upon predetermined data or a memory location. It is to be noted that a portion of the internal gripping tool 110 is configured to be inserted into the external joining tool 105 in order to position the pipe joint 75 within the external joining tool 105 as shown in FIG. 7. At this point, the spider would then re-take the weight of the pipe joint 75 to allow the internal gripping tool 110 to disengage. As also shown in FIG. 7, the elevator 120 has engaged the pipe joint 80. After the elevator 120 is disposed around the pipe joint 80, the slips in the elevator 120 are set so that the elevator 120 can support the weight of the pipe joint 80.

Figure 8:
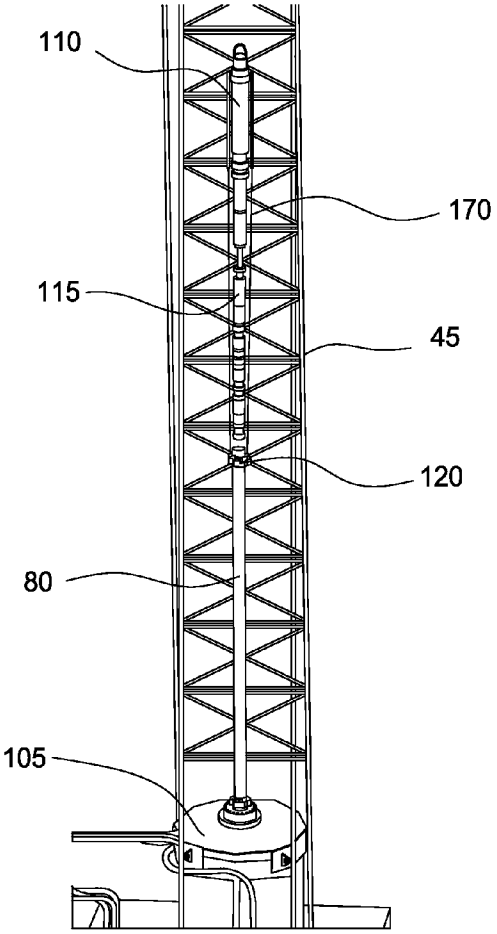
FIG. 8 illustrates the positioning of another pipe joint relative to the joining assembly.
Figure 9B:
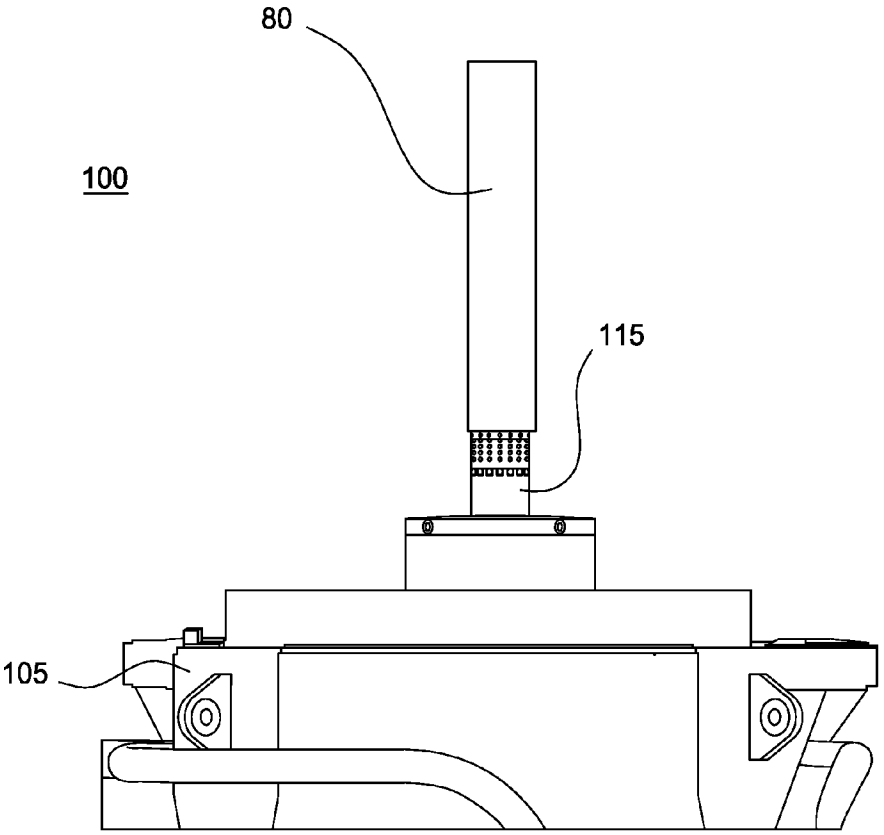
FIGS. 9A and 9B illustrate the positioning of an internal joining tool.
Figure 9A:
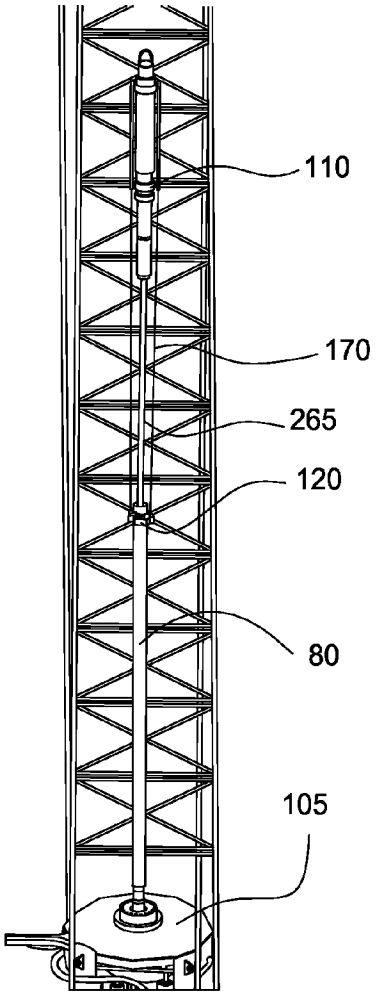

FIG. 8 illustrates the elevator 120 supporting the pipe joint 80 after the pipe joint 80 has been lifted from the V-door. Additionally, the pipe joint 80 is positioned such that a lower end of the pipe joint 80 is located near the opening of the external joining tool 105. As also shown in FIG. 8, the winch device has positioned the internal joining tool 115 in the parked position. FIGS. 9A-9B illustrate the positioning of the internal joining tool 115 to the weld position within the pipe joint 80. Generally, the weld position is a location in which the internal joining tool 115 straddles the pipe joints 75, 80. After the pipe joint 80 is positioned relative to the external joining tool 105, the internal joining tool 115 is lowered into the pipe joint 80 by activating the winch device 150, as shown in FIG. 9A. As shown in FIG. 9B, the internal joining tool 115 is lowered until a portion of the internal joining tool 115 is positioned in the pipe joint 80 and a portion of the internal joining tool 115 is positioned in the pipe joint 75 (which is inside the external joining tool 105).

Figure 10:
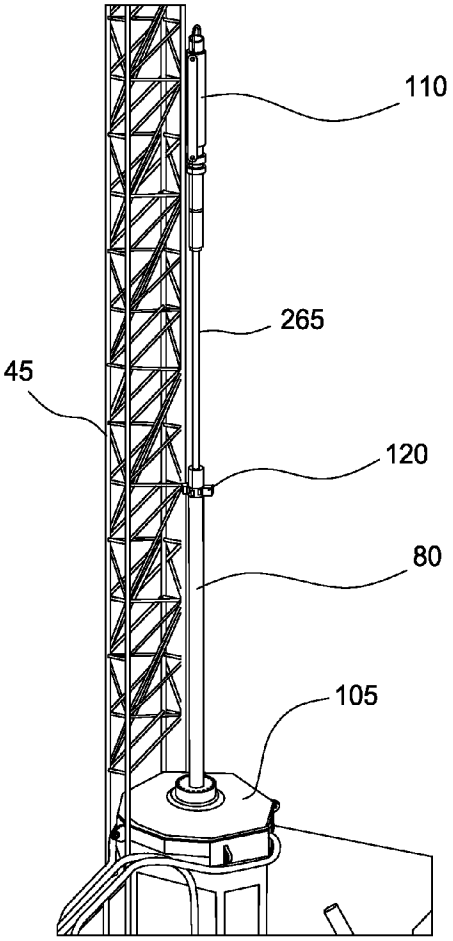
FIG. 10 illustrates the positioning of an end of the pipe joint in the joining assembly.

FIG. 10 illustrates the positioning of the pipe joint 80 in the external joining tool 105. The lower end of the pipe joint 80 is located within the external joining tool 105 such that the lower end of the pipe joint 80 is proximate the upper end of the pipe joint 75. At this point, the internal joining tool 115 may also prepare the joining area around the ends of the pipe joints 75, 80. In one embodiment, the preparation of the joining area may include cleaning the surfaces of the end of each pipe joint 75, 80 and/or preparing the edges of the end of each pipe joint 75, 80. Thereafter, the joining operation is performed by the internal joining tool 115 and the external joining tool 105, and the pipe joint 80 becomes attached to the pipe joint 75 to form a string of pipe. An example of such a joining operation is described in U.S. Pat. No. 7,181,821, which is herein incorporated by reference. The joining operation may be concluded by verifying the integrity of the joint made.

Figure 12:
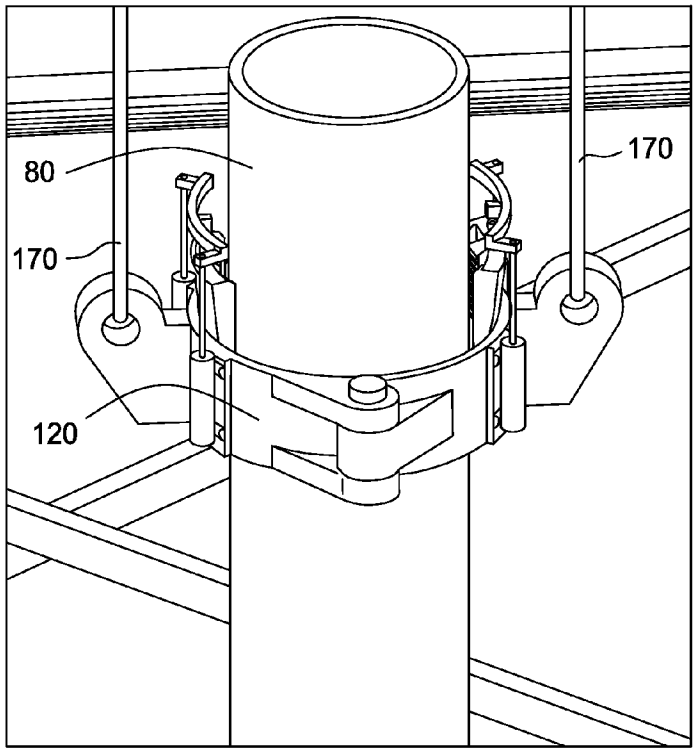
FIG. 12 illustrates the release of an elevator from the pipe joint.
Figure 11:
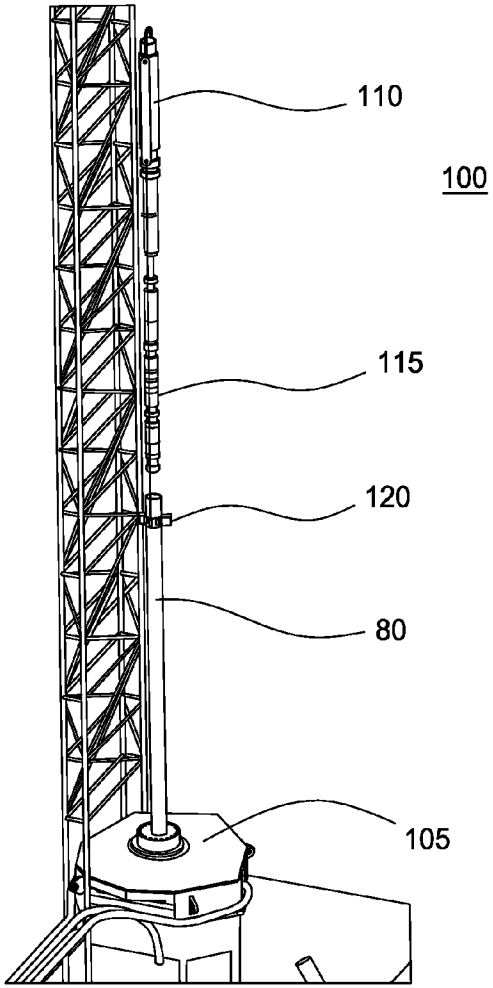
FIG. 11 illustrates the removal of the internal joining tool from the pipe joint.

FIG. 11 illustrates the removal of the internal joining tool 115 from the pipe joint 80. After the joining operation is complete, the internal joining tool 115 is moved from the weld position to the parked position. At this point, the string of pipe (e.g., 75, 80) is supported by the spider, and therefore the elevator 120 may be released from the pipe joint 80, as shown in FIG. 12.

Figure 13:
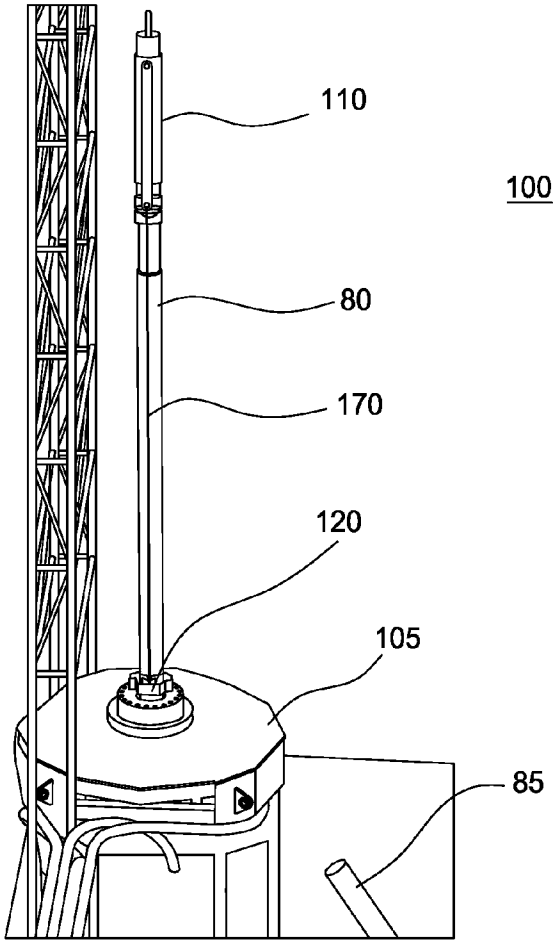
FIG. 13 illustrates the internal gripping tool gripping an end of the pipe joint.
Figure 14:
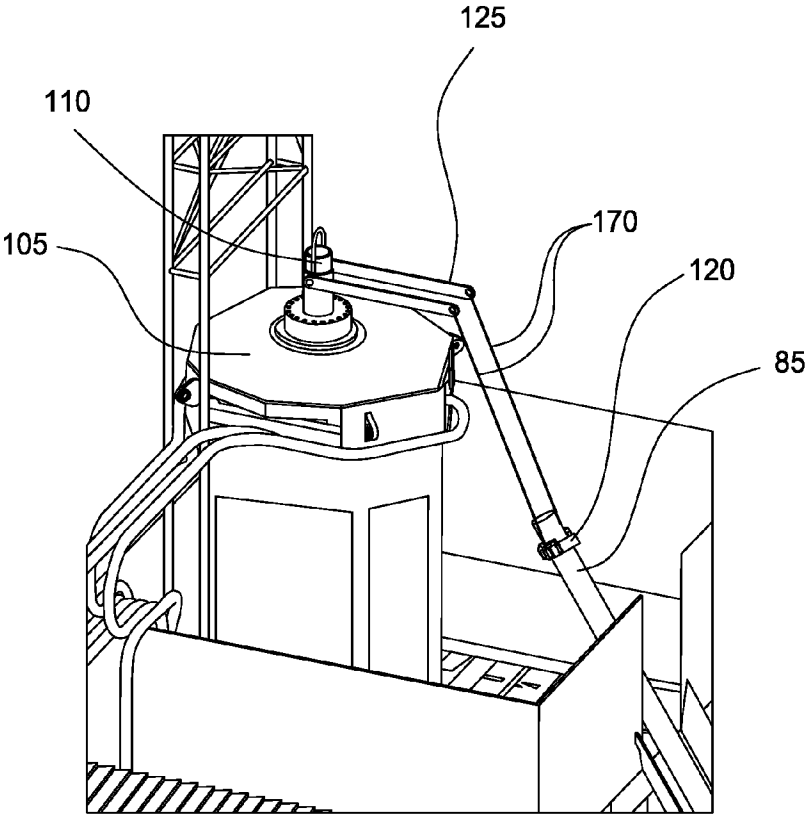
FIG. 14 illustrates the positioning an end of the pipe joint in the joining assembly.

FIG. 13 illustrates the positioning of the internal gripping tool 110 within the string of pipe. The internal gripping tool 110 is lowered until a portion of the internal gripping tool 110 is located within the string of pipe. Thereafter, the gripping elements 195 of the internal gripping tool 110 are activated. With the internal gripping tool 110 engaged, the internal gripping tool 110 can take the weight of string of pipe so the spider can be opened. As also shown in FIG. 13, the elevator 120 has been moved down the string of pipe. FIG. 14 illustrates the positioning of an upper end of the string of pipe in the external joining tool 105. As shown in FIG. 14, the internal gripping tool 110 lowers the string of pipe into the external joining tool 105 until the upper end of the string of pipe is in the correct position within the external joining tool 105. This position may be achieved by a physical stop between the internal gripping tool 110 and a top of the external joining tool 105. At this point, the spider would then re-take the weight of the string of pipe to allow the internal gripping tool 110 to disengage. As also shown in FIG. 14, the elevator 120 has engaged a pipe joint 85. After the elevator 120 is disposed around the pipe joint 85, the slips in the elevator 120 are set so that the elevator 120 can support the weight of the pipe joint 85. This process would continue until all joints have been run into the wellbore.

Figure 15A:
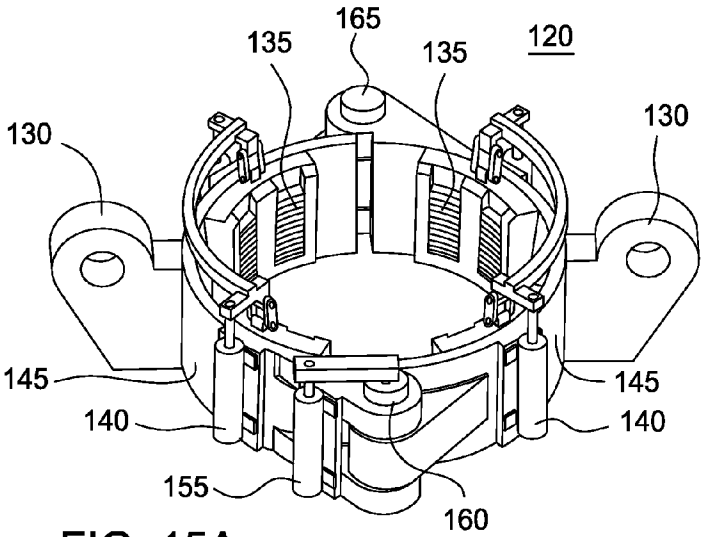
FIGS. 15A-15D illustrate the operation of the elevator.
Figure 15B:
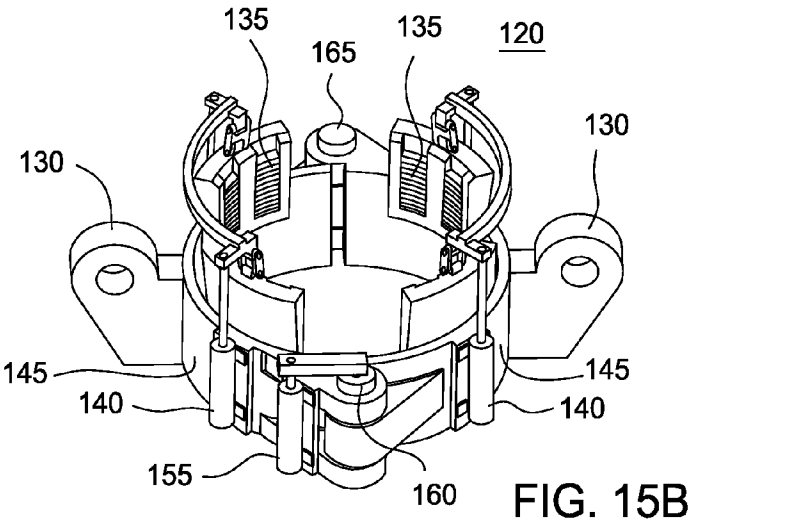
Figure 15C:
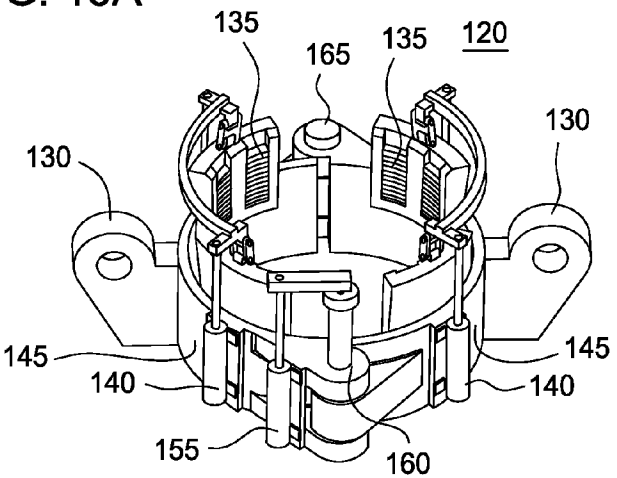
Figure 15D:
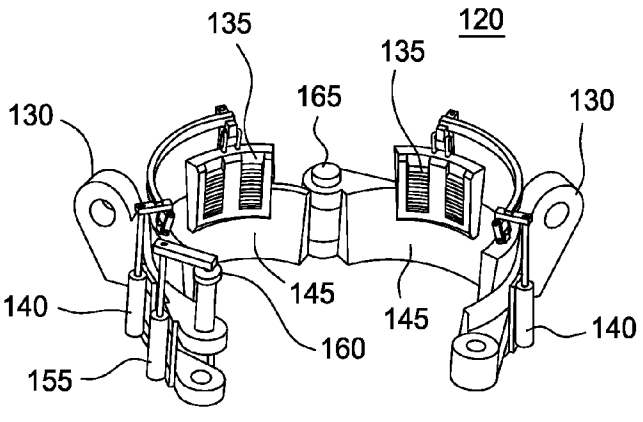

FIGS. 15A-15D illustrate the elevator 120. As shown in FIG. 15A, the elevator 120 includes one or more doors 145 that are connected by a pin 165 at one end and a pin 160 at another end. Either or both pins 160, 165 may be selectively removable to allow door(s) to open. Either or both pins 160, 165 may additionally serve as hinges. The elevator 120 further includes a plurality of slips 135 which are configured to engage a pipe joint upon activation of the elevator 120. As shown in FIG. 15B, the slips 135 are movable relative to the doors 145 by using cylinder members 140. The elevator 120 also includes lifting lugs 130 attached to each door 145. The lifting lugs 130 are used to connect the elevator 120 to the link-tilt device 125 via cables 170.

The elevator 120 is moveable between a closed position (FIG. 15A), an activated position (FIG. 15B), a pin release position (FIG. 15C) and an opened position (15D). In the closed position, the elevator 120 is positioned around the pipe joint (not shown). In the activated position, the slips 135 have moved relative to the doors 145 to allow the elevator 120 to engage the pipe joint. The slips 135 are moved by the cylinder members 140. In the pin release position, the pin 160 shown to have been is moved relative to the doors 145 such that the ends of the doors 145 may be released from each other. The pin 160 is moved by cylinder member 155. In the opened position, the doors 145 are shown to pivot around the pin 165 in a direction away from each other. The opened position allows the elevator 120 to be released from a pipe joint and/or engage a pipe joint. The operation of the elevator 120 may be configured to be controlled by a remote device.

Figure 17:
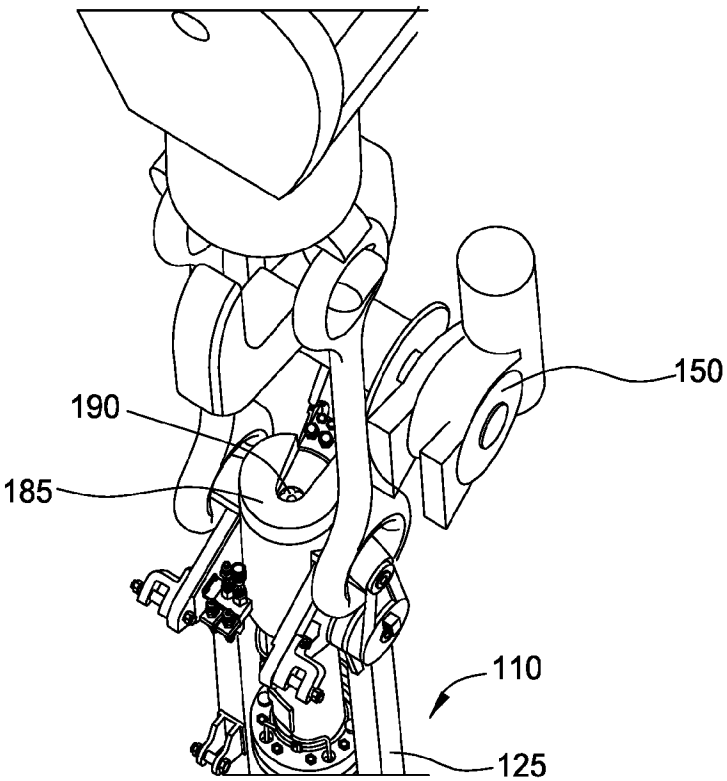
FIGS. 16 and 17 illustrate the internal gripping tool.
Figure 16:
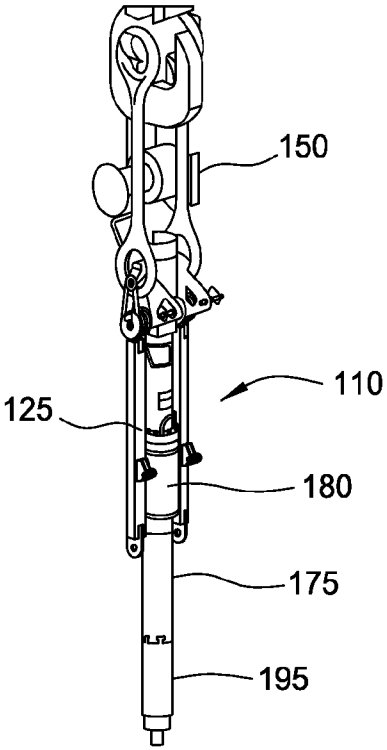

FIGS. 16 and 17 illustrate the internal gripping tool 110. As shown in FIG. 16, the internal gripping tool 110 includes radially movable gripping elements 195, such as slips, gripping fingers, etc. The gripping elements 195 are moveable between a disengaged position and an engaged position. When the gripping elements 195 are in the disengaged position, the internal gripping tool 110 may be positioned within a pipe joint (see FIG. 5). Thereafter, the gripping elements 195 may be moved to the engaged position such that the internal gripping tool 110 engages (or grips) the pipe joint. The internal gripping tool 110 further includes a pipe positioning mandrel 175 for use in positioning the internal gripping tool 110 within the pipe joint. The internal gripping tool 110 further includes a ring cylinder housing 180.

As shown in FIG. 17, the winch 150 is located above the internal gripping tool 110. As set forth herein, the winch 150 is used to move the internal joining tool 115 between the parked position and the weld position with the use of the umbilical cable 265. An umbilical guide 185 is disposed at an upper end of the internal gripping tool 110 in order to guide the umbilical cable 265 that is controlled by the winch 150. The internal gripping tool 110 further includes an umbilical path 190 formed through a portion of the internal gripping tool 110. The umbilical path 190 and the umbilical guide 185 in the internal gripping tool 110 allow the winch 150 to extend and retract the umbilical cable 265 without interfering with the operation of the internal gripping tool 110.

Figure 18:
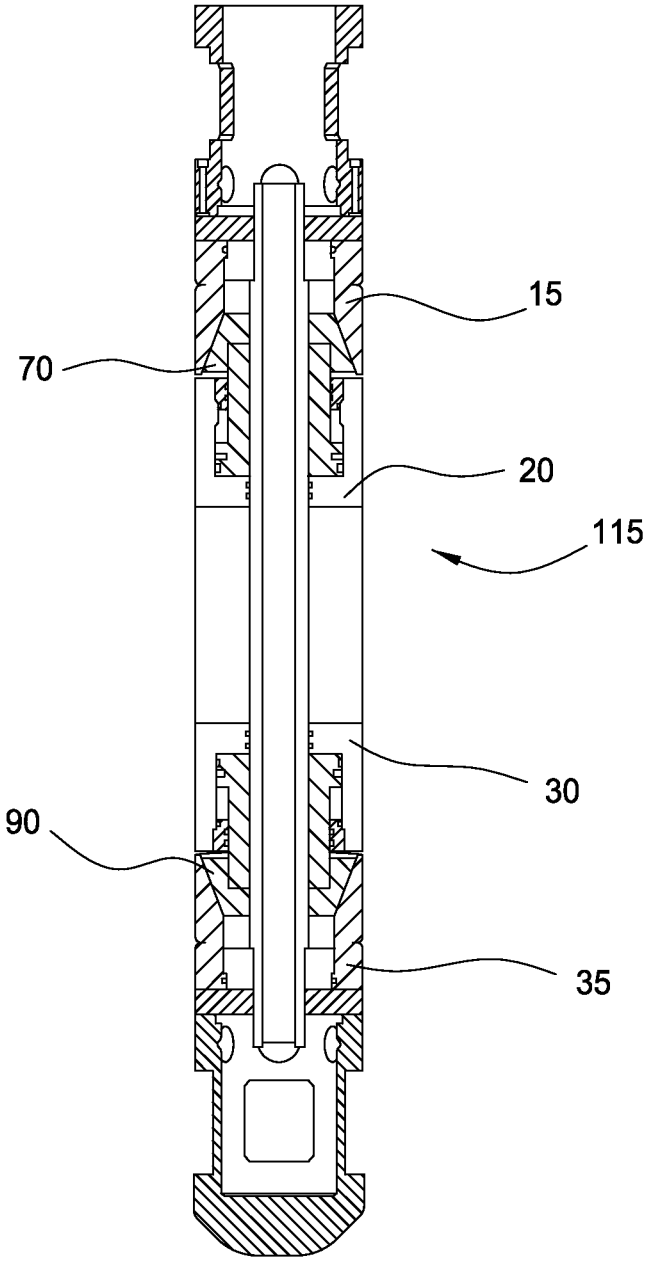
FIG. 18 illustrates the internal joining tool.

FIG. 18 illustrates an embodiment of the internal joining tool 115. The internal joining tool 115 includes a first seal member 15 and a second seal member 35. The seal members 15, 35 are used to seal a joining area between the pipe joints. Specifically, the first seal member 15 creates a seal within an inner diameter of one pipe joint (e.g., pipe joint 80, FIG. 9A), and the second seal member 35 creates a seal within an inner diameter of another pipe joint (e.g., pipe joint 75). The first seal member 15 is activated by urging a ram 70 into engagement with the seal member 15. The ram 70 is moved relative to the seal member 15 by using a ram activation assembly 20. In a similar manner, the second seal member 35 is activated by urging a ram 90 into engagement with the seal member 35. The ram 90 is moved relative to the seal member 35 by using a ram activation assembly 30.

During the joining operation, the internal joining tool 115 may be used to position the pipe joints by moving the upper pipe joint (e.g., pipe joint 80) toward the lower pipe joint (e.g., pipe joint 75) such that the ends of the pipe joints are spaced apart by a predetermined distance or the ends are in contact with each other. When the internal joining tool 115 positions the upper pipe joint for the joining operation, the slips of the elevator may be opened to accommodate the pipe movement and/or an optional compensator attached to the top drive, the internal gripping tool 110, etc. may be used to accommodate the pipe movement. Thereafter, the internal joining tool 115 and the external joining tool 105 would perform the joining (e.g. welding or forging) operation to connect the pipe joints.

FIGS. 19-27 illustrate a pipe handling system 200 for use with a joining (e.g. welding or forging) assembly comprising an internal joining tool 230 and an external joining tool 205. The internal joining tool 230 may be used to grip the pipe joint, seal an annulus in the pipe joint or any other procedure necessary for the joining operation. The components of the pipe handling system 200 will be described in relation to FIGS. 19A-19C and the operation of the pipe handling system 200 will be described in relation to FIGS. 20-27. As shown in FIG. 19A, the system 200 includes a top drive assembly 225 with a link-tilt device 125. The link-tilt device 125 may be used pivot the link arms out and back as required using suitable piston-cylinder activation. The top drive assembly 225 is typically attached to a rig (not shown). An elevator 215 is connected to the top drive assembly 225 by bails attached to the link-tilt device 125. The elevator 215 may include a door arrangement that allows the elevator 215 to pick up pipe from a pipe ramp 65 adjacent a drill floor 50. Additionally, the elevator 215 may include slips to hold the weight of each pipe joint and the pipe string after the joining process is complete.

Figure 19A:
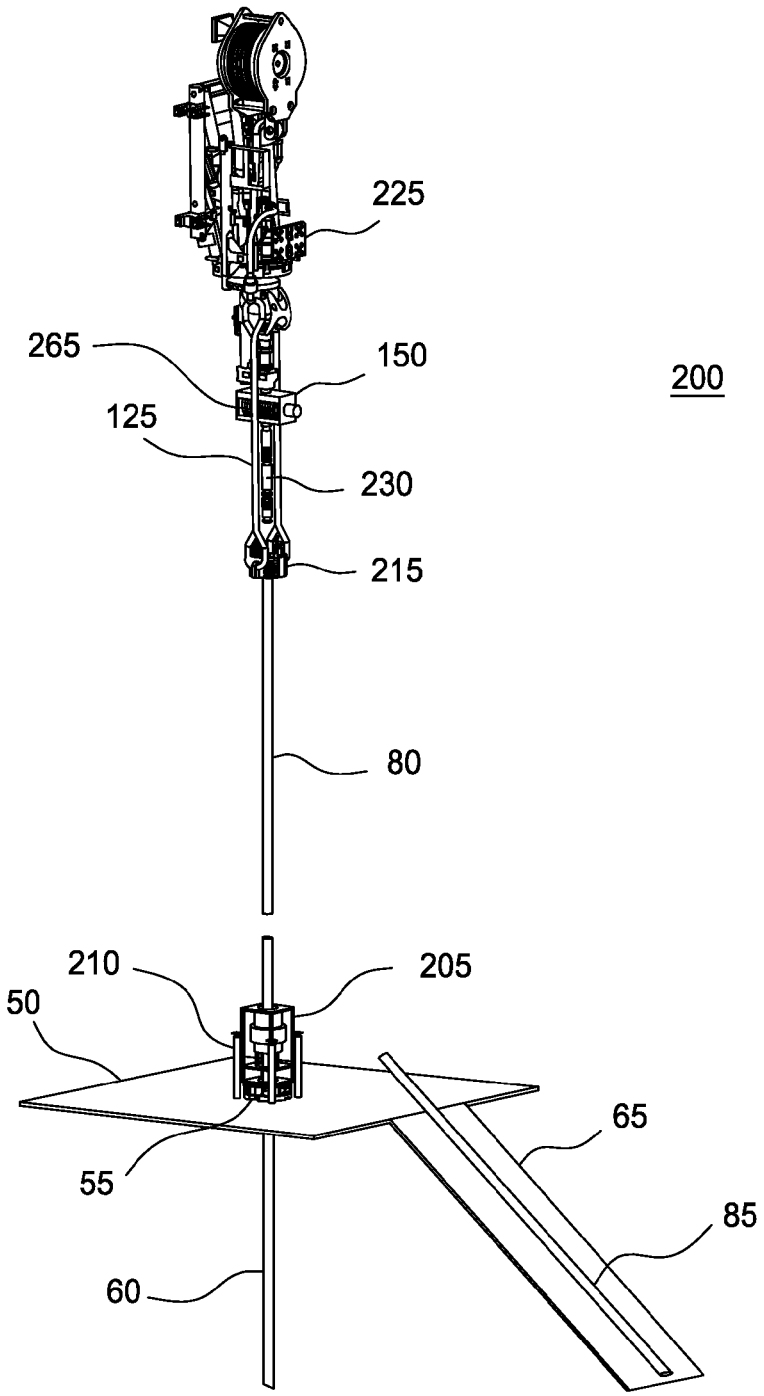
FIGS. 19A-19C illustrate a pipe handling system for use with a joining assembly.
Figure 19B:
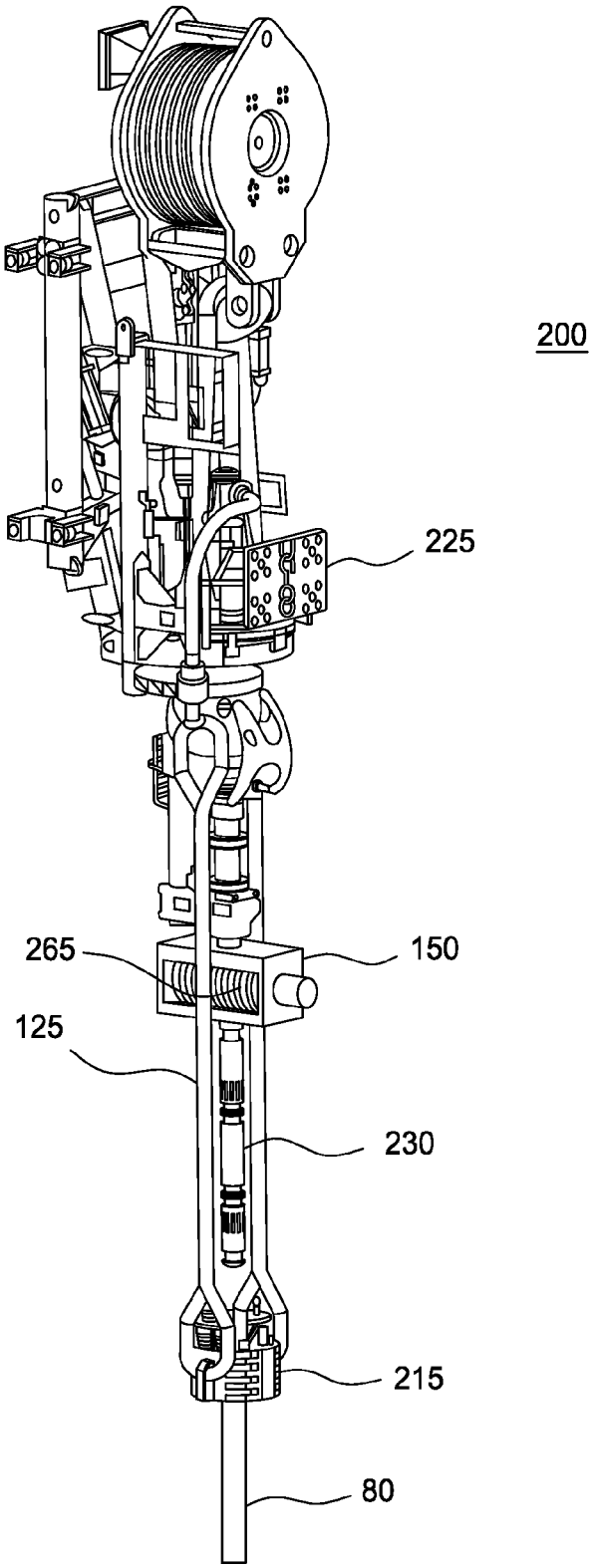
Figure 19C:
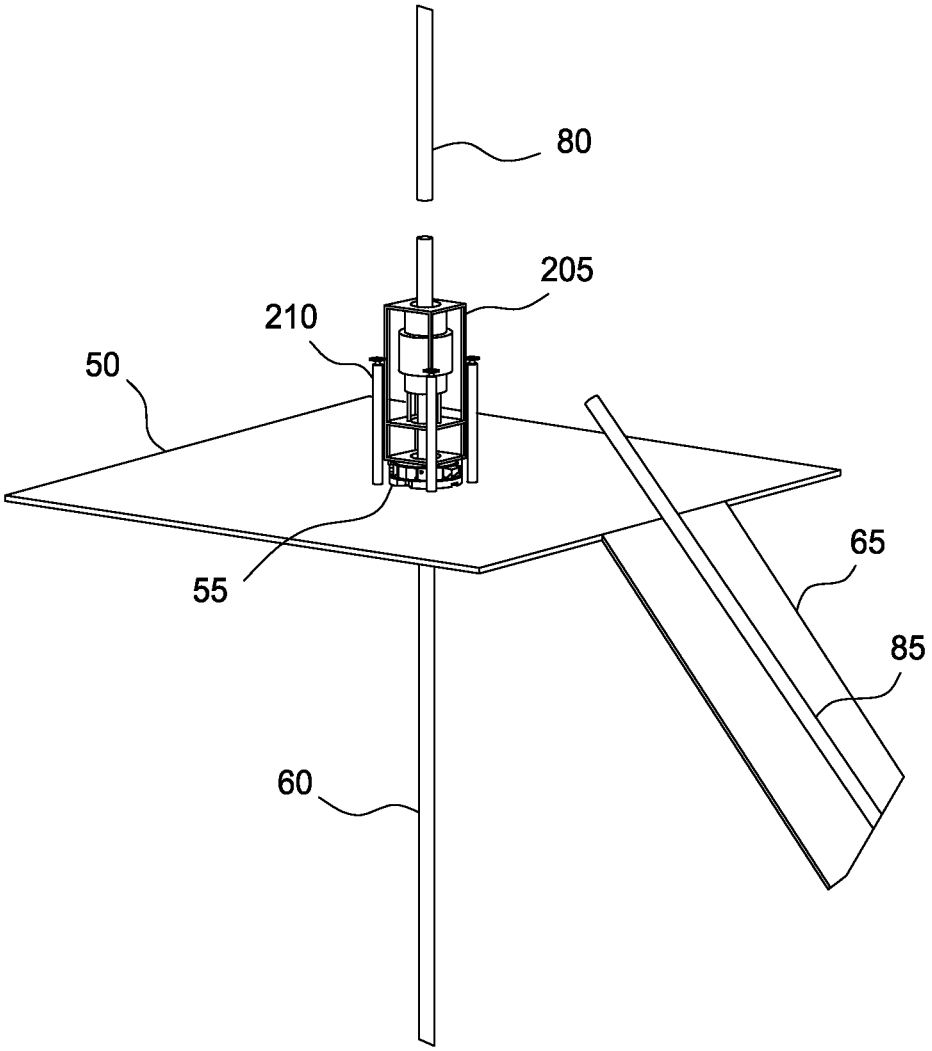

As shown in FIG. 19B, the system 200 further includes a winch device 150 attached to the top drive assembly 225. The winch device 150 includes an umbilical cable 265 that is connected to the internal joining tool 230. As will be described herein, the umbilical cable 265 is used to move the internal joining tool 230 between a parked position and a weld position. The umbilical cable 265 is also used to supply the power to the internal joining tool 230. As shown in FIG. 19C, the system includes a spider 55 at the drill floor 50. The spider 55 is configured to handle the pipe and hold the string of pipe while the next pipe joint is being joined.

Figure 20:
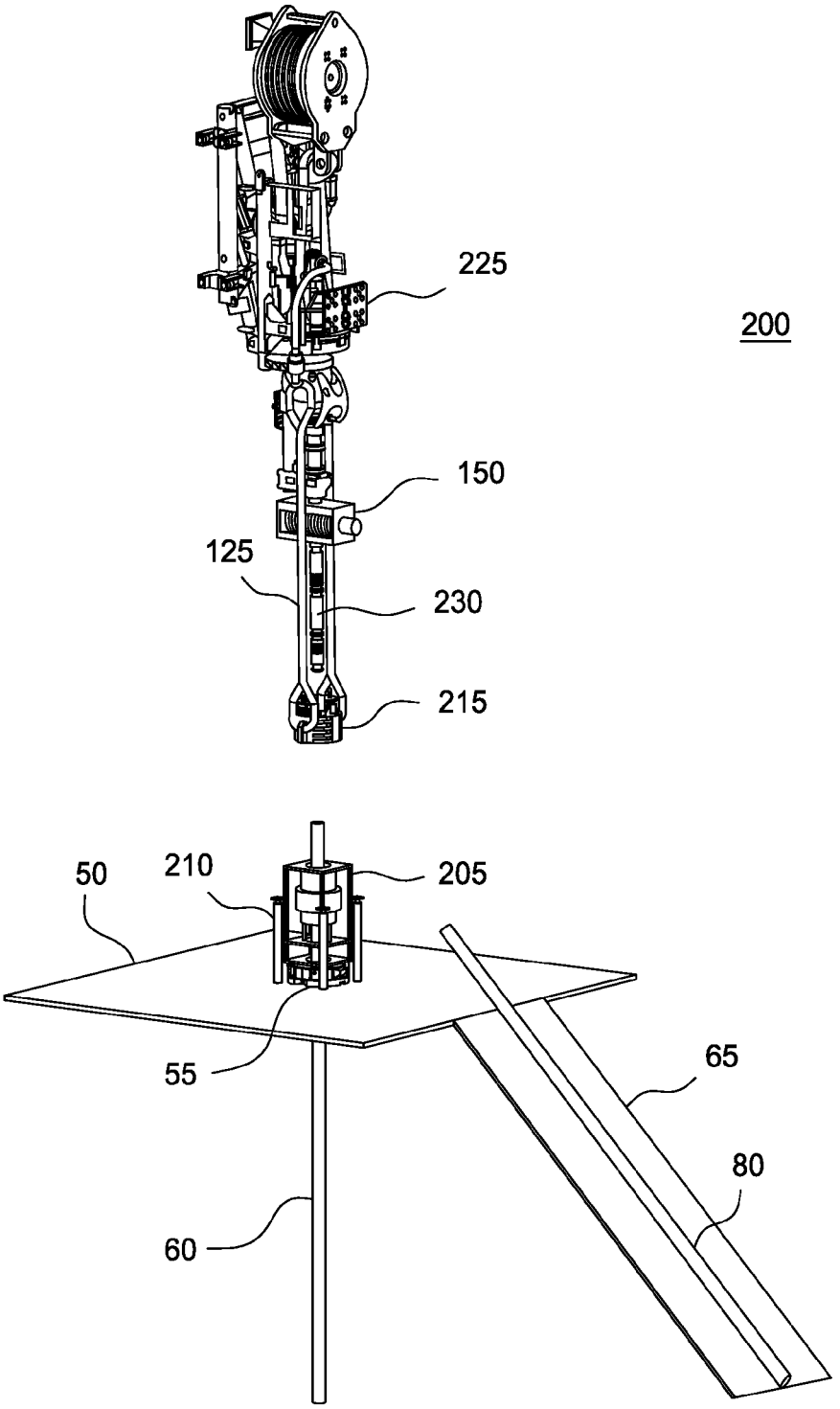
FIGS. 20 and 21 illustrate the positioning of an elevator in the pipe handling system.
Figure 21:
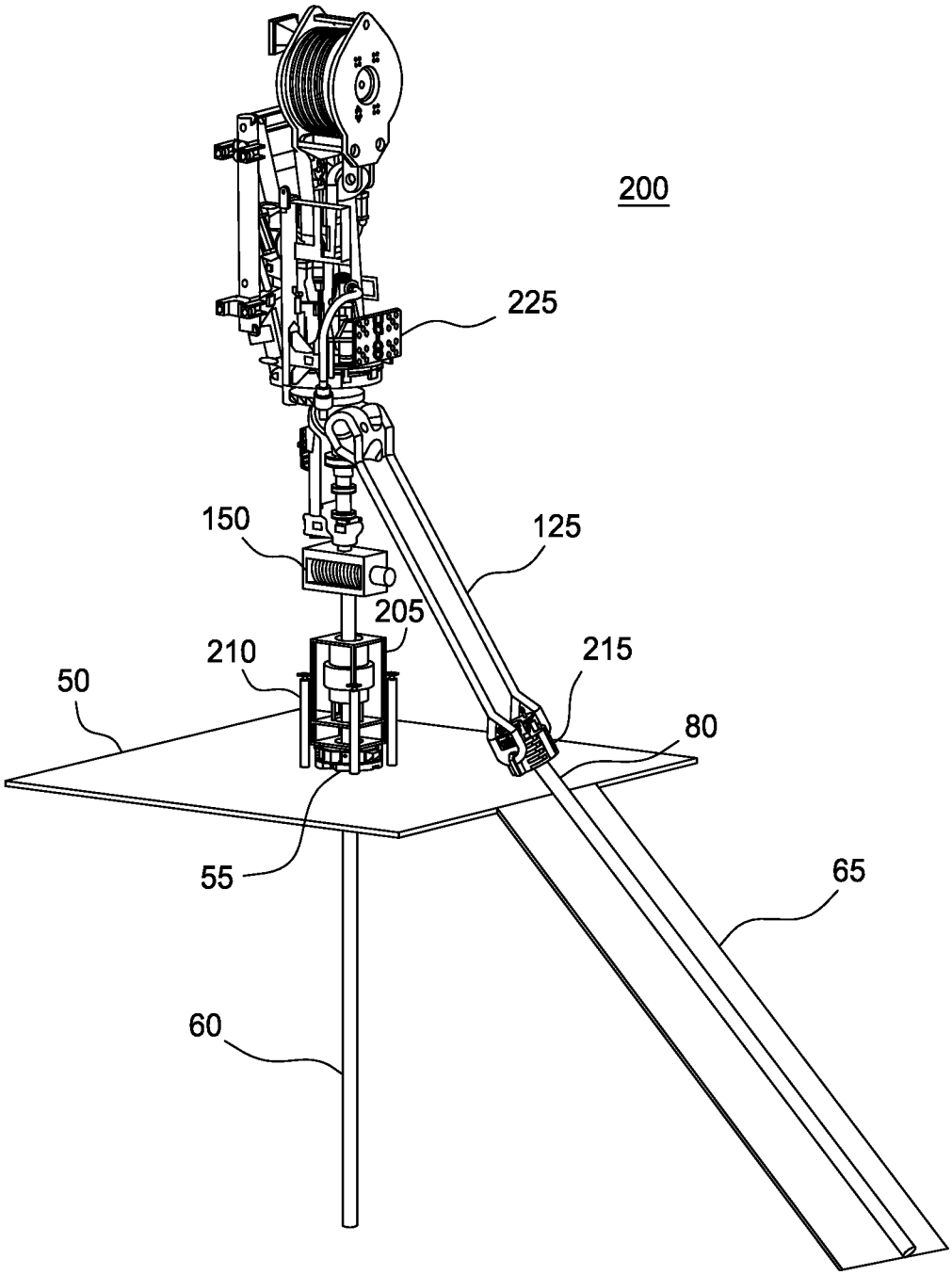
Figure 22:
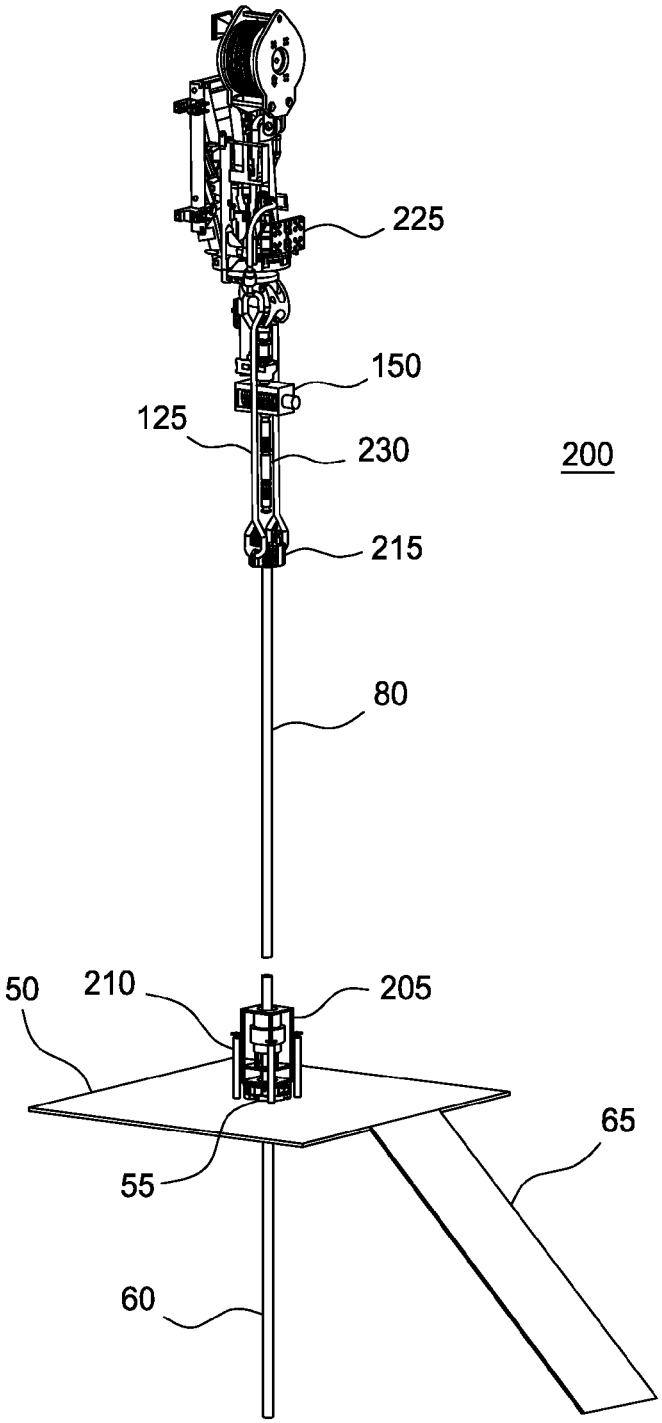
FIG. 22 illustrates the elevator supporting a pipe joint.
Figure 23A:
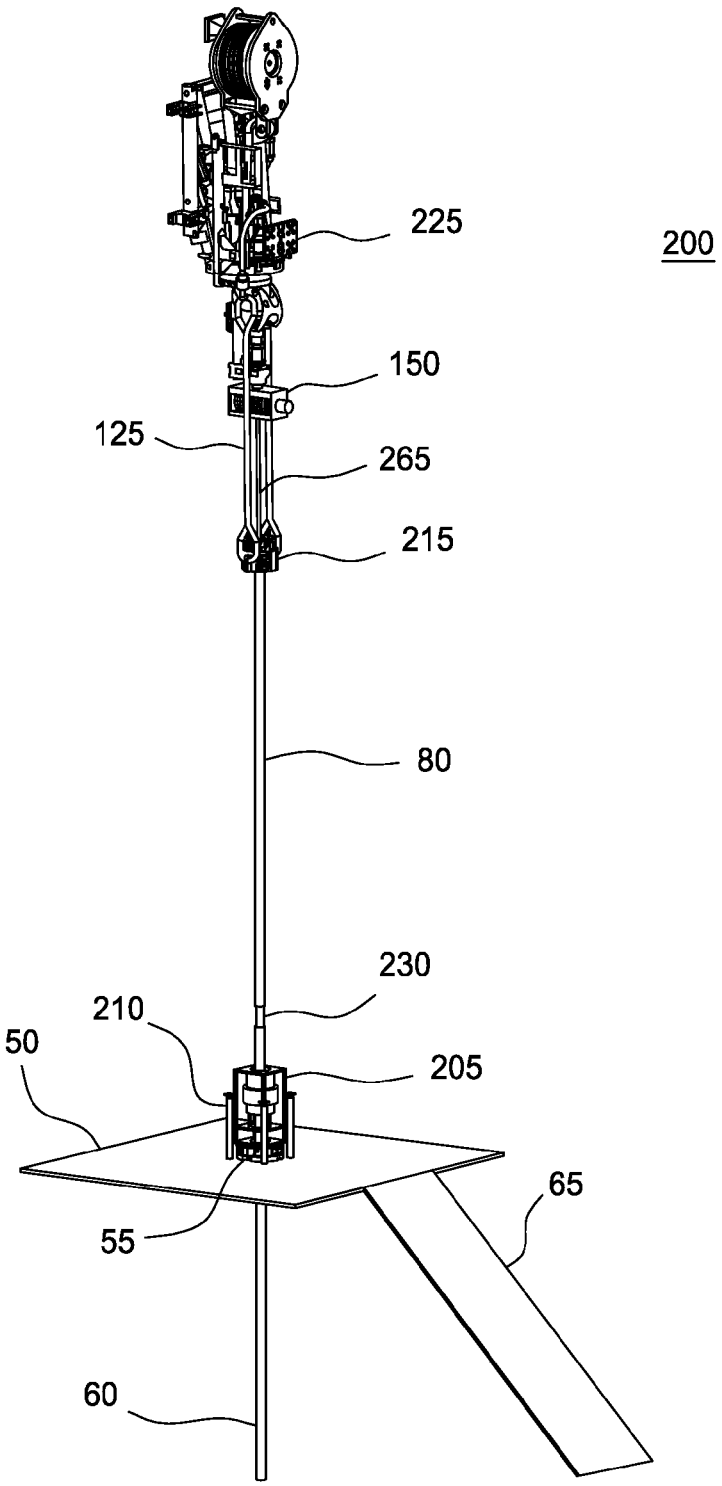
FIGS. 23A-23C illustrate the positioning of an internal joining tool in the pipe joint.
Figure 23B:
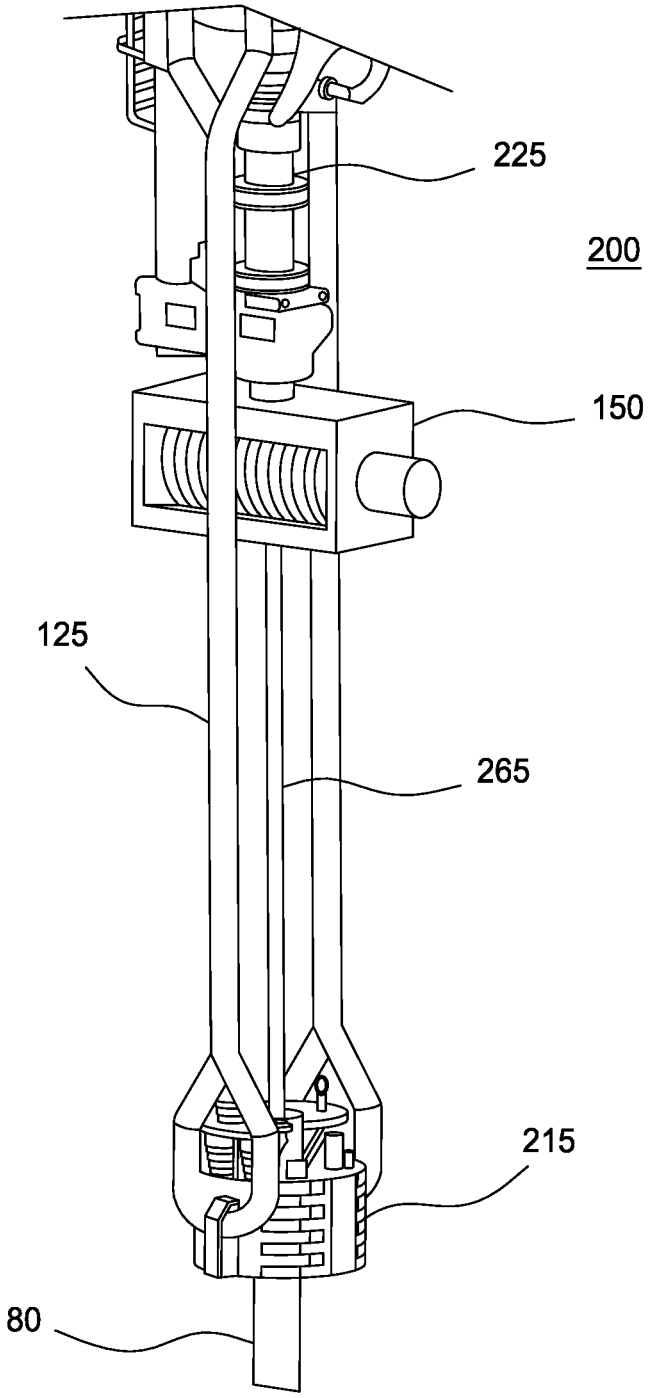
Figure 23C:
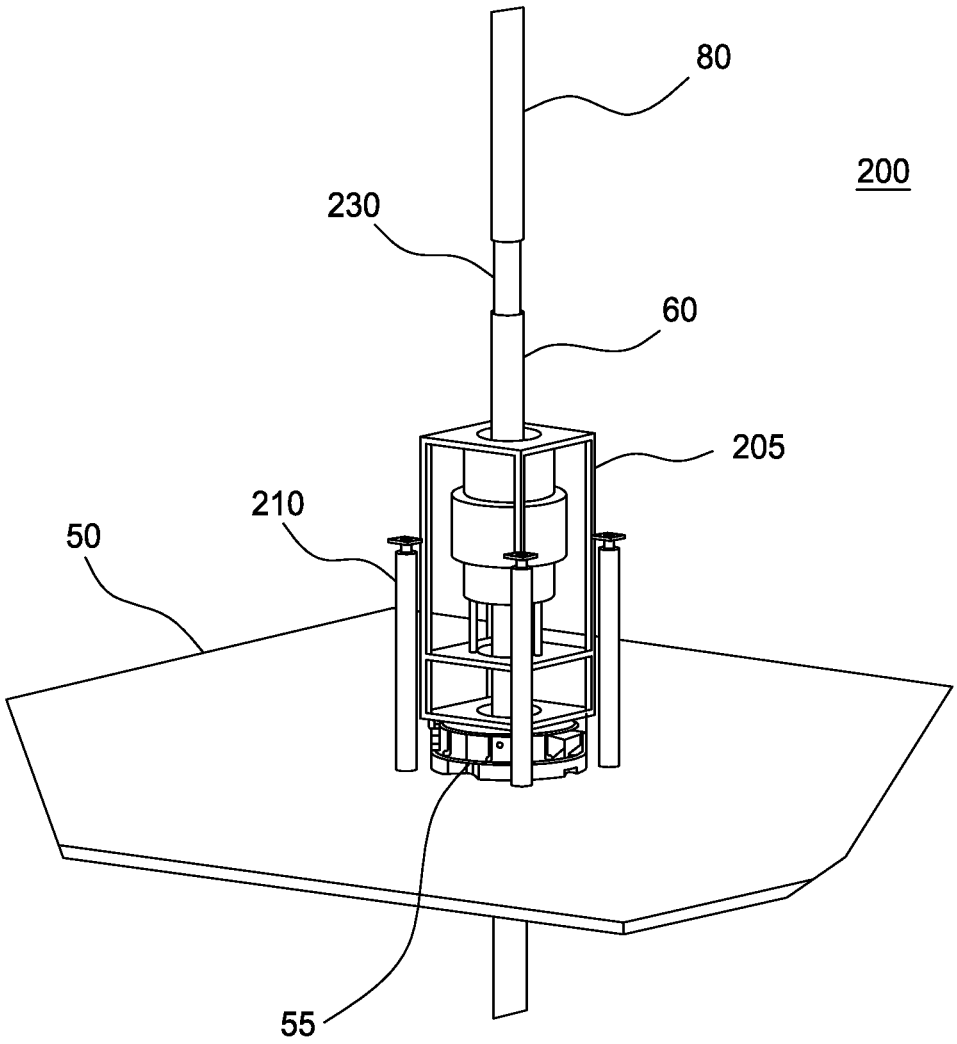

FIGS. 20-27 illustrate the joining operation using the pipe handling system 200. As shown in FIG. 20, the elevator 215 is lowered toward the drill floor 50. As also shown in FIG. 20, the winch device 150 has positioned the internal joining tool 230 in the parked position. FIG. 21 illustrates the elevator 215 being positioned adjacent a pipe joint 80 by utilizing the link-tilt device 125 to adjust the location of the bails. After the elevator 215 is disposed around the pipe joint 80, the slips in the elevator 215 are set so that the elevator 215 can support the weight of the pipe joint 80. FIG. 22 illustrates the elevator 215 supporting the pipe joint 80 after the pipe joint 80 has been lifted from the pipe ramp 65. Additionally, the pipe joint 80 is moved toward a string of pipe 60 which is supported by the spider 55. FIGS. 23A-23C illustrate the positioning of the internal joining tool 230 to the weld position within the pipe joint 80. After the pipe joint 80 is positioned relative to the string of pipe 60, the internal joining tool 230 is lowered into the pipe joint 80 by activating the winch device 150, as shown in FIG. 23B. The internal joining tool 230 is lowered until a portion of the internal joining tool 230 is positioned in the pipe joint 80 and a portion is positioned in the string of pipe 60, as shown in FIG. 23C. At this point, a flaring device in the internal joining tool 230 may be activated to flare out a lower end of the pipe joint 80 and an upper end of the string of pipe 60. In another embodiment, the pipe joint 80 may have a preformed flare. In such instance, optionally the elevator 215 without slips may be used to pick-up the pipe joint.

Figure 24:
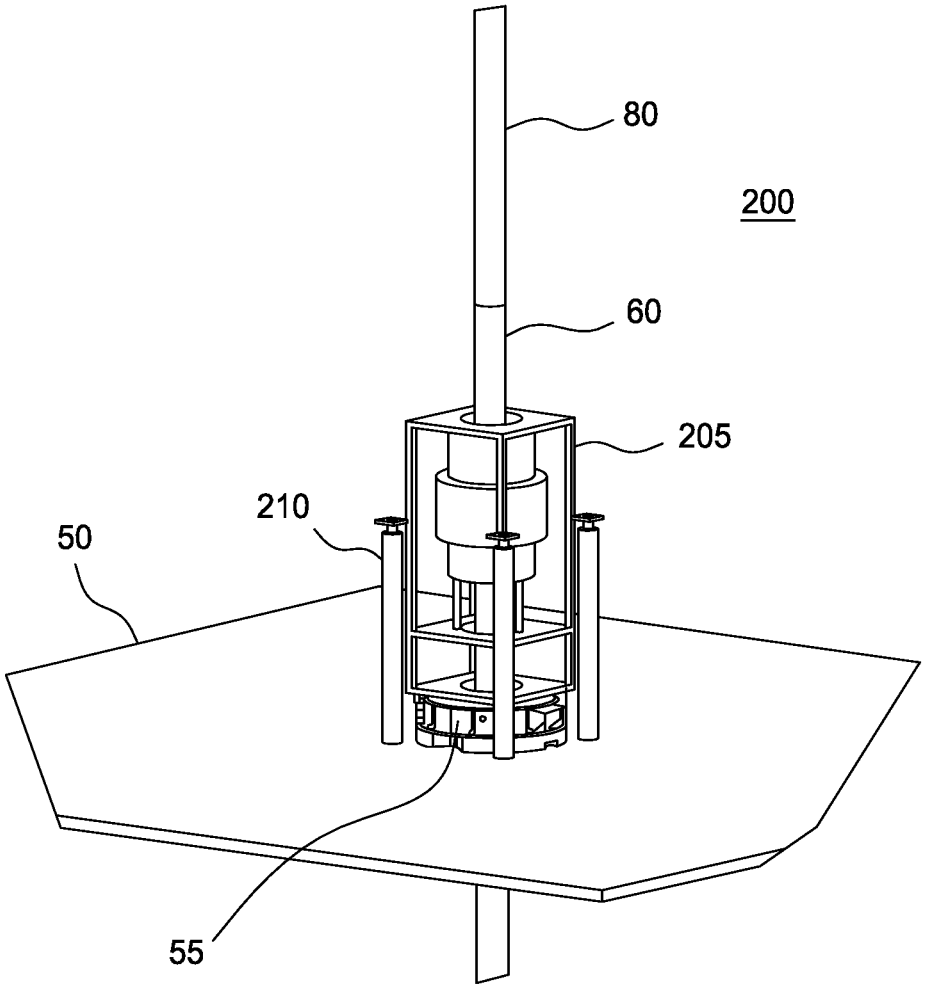
FIG. 24 illustrates an end of the pipe joint positioned adjacent an end of a string of pipe.

FIG. 24 illustrates the end of the pipe joint 80 positioned adjacent the end of the string of pipe 60. After the ends of the pipes are flared, the top drive assembly 225 lowers the pipe joint 80 until the end of the pipe joint 80 is proximate the end of the string of pipe 60. It is to be noted that the internal joining tool 230 is in the weld position within the pipe joint 80 and the string of pipe 60. During the joining operation, the internal joining tool 230 may be used to position the pipe joints by moving the pipe joint 80 toward the string of pipe 60 such that the ends of the pipe joints are spaced apart by a predetermined distance or the ends are in contact with each other. When the internal joining tool 230 positions the pipe joint 80 for the joining operation, the slips of the elevator 215 may be opened to accommodate the pipe movement and/or an optional compensator attached to the top drive assembly 225, the elevator 215, etc. may be used to accommodate the pipe movement.

Figure 25:
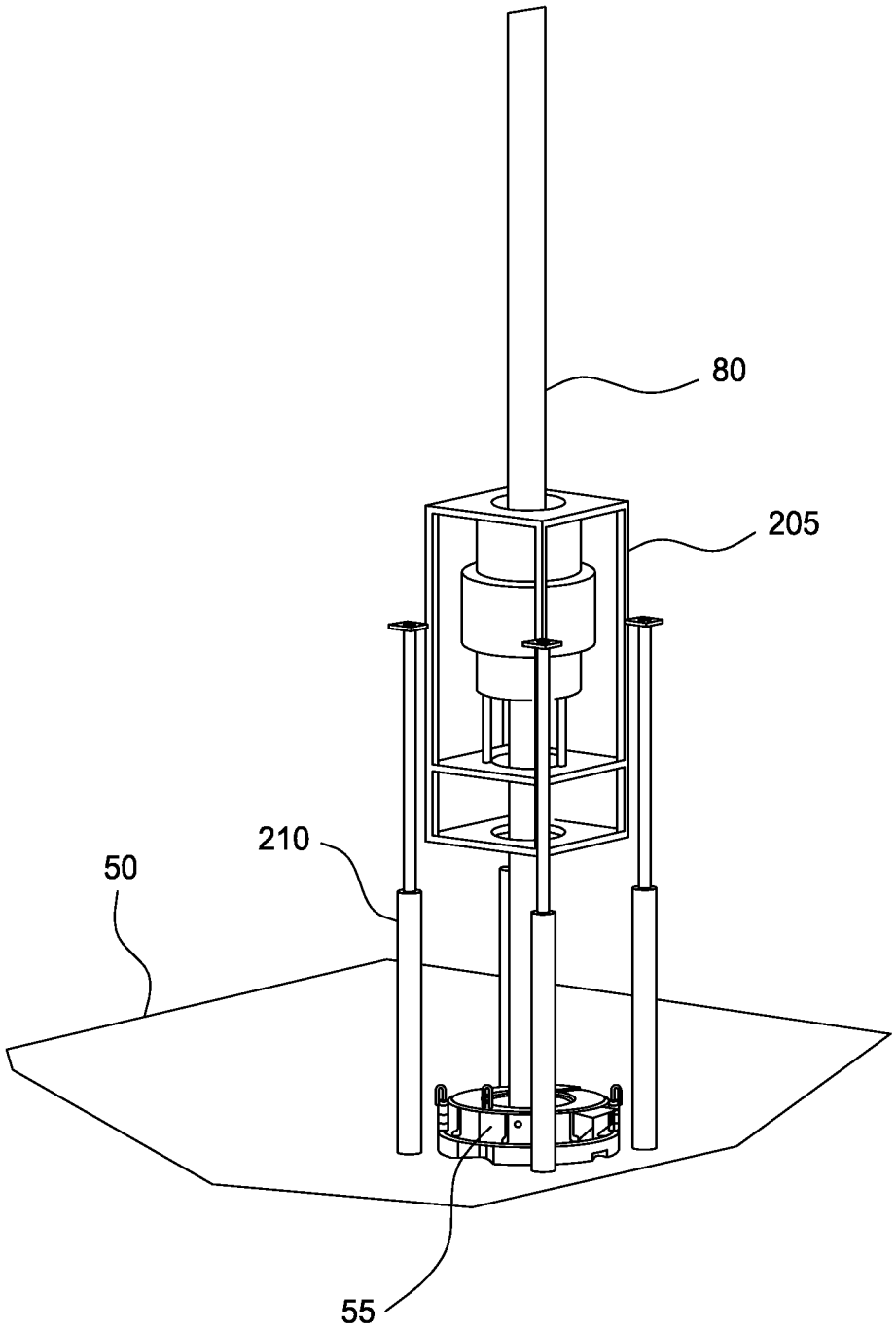
FIG. 25 illustrates the positioning of an external joining tool.

FIG. 25 illustrates the positioning of the external joining tool 205. A plurality of cylinders 210 is activated to move the external joining tool 205 proximate the connection point. At this point, the elevator 215 may open the slips to allow the internal joining tool 230 to position the pipe joint 80 and the string of pipe 60 for the joining (e.g. welding or forging) operation. The internal joining tool 230 may also prepare the joining area around the connection point. In one embodiment, the preparation of the joining area may include cleaning the surfaces of the end of each pipe joint 75, 80 and/or preparing the edges of the end of each pipe joint 75, 80. Thereafter, the joining (e.g. welding or forging) operation is performed by the internal joining tool 230 and the external joining tool 205, and the pipe joint 80 becomes part of the string of pipe 60. The joining operation may be concluded by verifying the integrity of the joint made.

Figure 26:
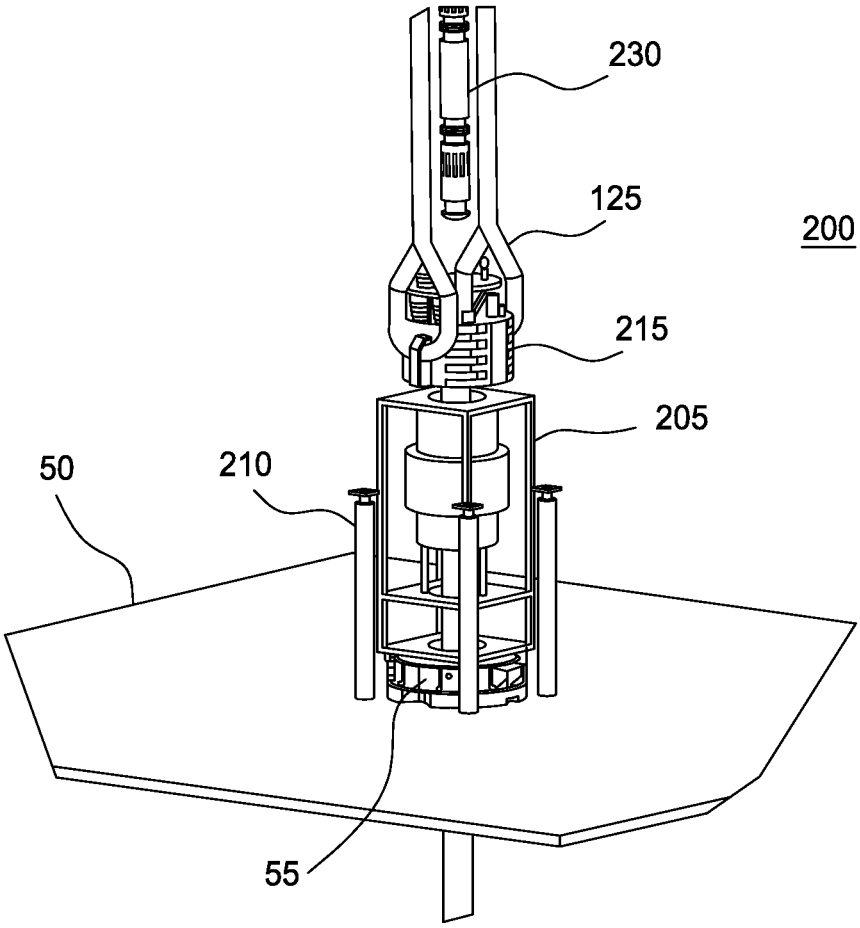
FIG. 26 illustrates the lowering of the string of pipe into a wellbore.

FIG. 26 illustrates the lowering of the string of pipe 60 into the wellbore. After the joining (e.g. welding or forging) operation is complete, the external joining tool 205 is lowered by retracting the cylinders 210. Additionally, the internal joining tool 230 moved to the parked position to allow space for the elevator 215 to lower the string of pipe 60 such that an end of the string of pipe 60 is positioned in the joining area to allow the next pipe joint to be added to the string of pipe 60. If the slips in the elevator 215 were opened during the joining operation, the slips in the elevator 215 would be re-set in preparation of handling the string of pipe 60. The winch device 150 would then retract the internal joining tool 230 to the parked position. With the elevator 215 engaged and the internal joining tool 230 positioned in the parked position, the elevator 215 can take the weight of the string of pipe 60 so the spider 55 can be opened. The string of pipe 60 would then be lowered by the top drive assembly 225 until the elevator 215 is right above the external joining tool 205, as shown in FIG. 26. Thereafter, the spider 55 would then re-take the weight of the string of pipe 60 to allow the elevator 215 to disengage and retrieve the next pipe joint from the pipe ramp 65. This process would continue until all joints have been run into the wellbore.

Figure 27:
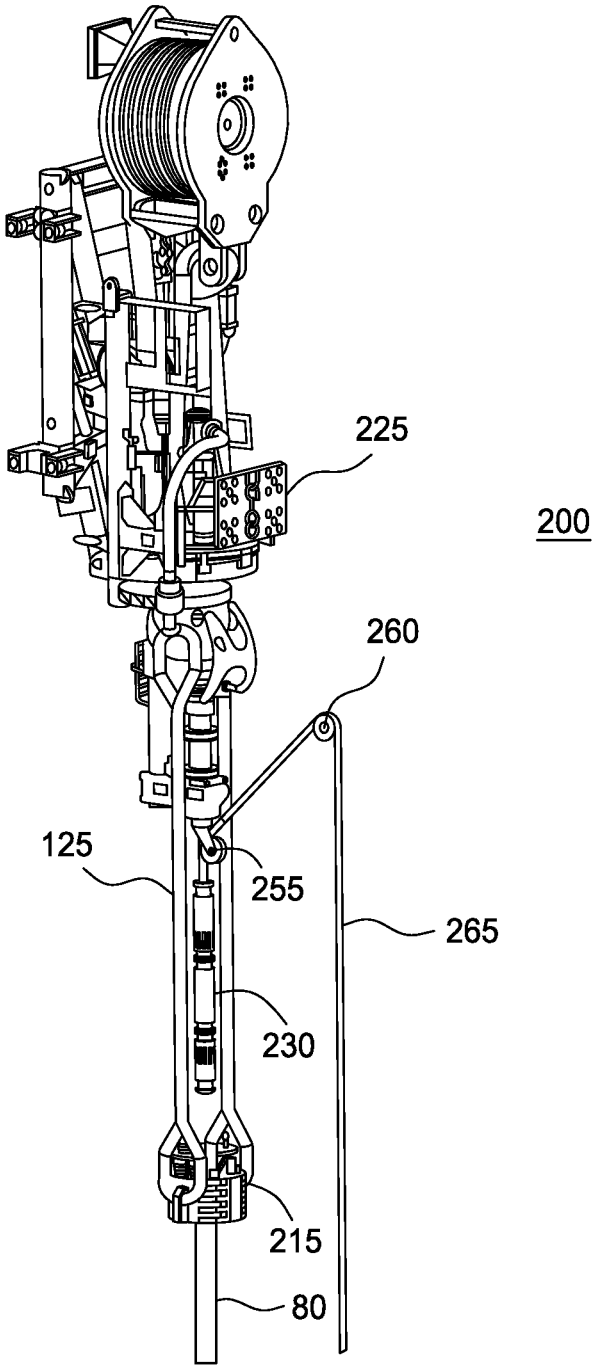
FIG. 27 illustrates the pipe handling system with a sheave arrangement.

FIG. 27 illustrates the pipe handling system 200 with a sheave arrangement. In the embodiment shown in FIG. 28, the winch device has been replaced with the sheave arrangement 255, 260. The sheave arrangement 255, 260 moves the internal joining tool 230 between the parked position and the weld position in a similar manner as described herein by utilizing the umbilical 265. It should be noted that the sheave arrangement may be used with each pipe handling system set forth herein.

FIGS. 28-35 illustrate a pipe handling system 300 for use with a joining assembly. For convenience, the components in the pipe handling system 300 that are similar to the components in the pipe handling system 100, 200 will be labeled with the same number indicator.

Figure 28:
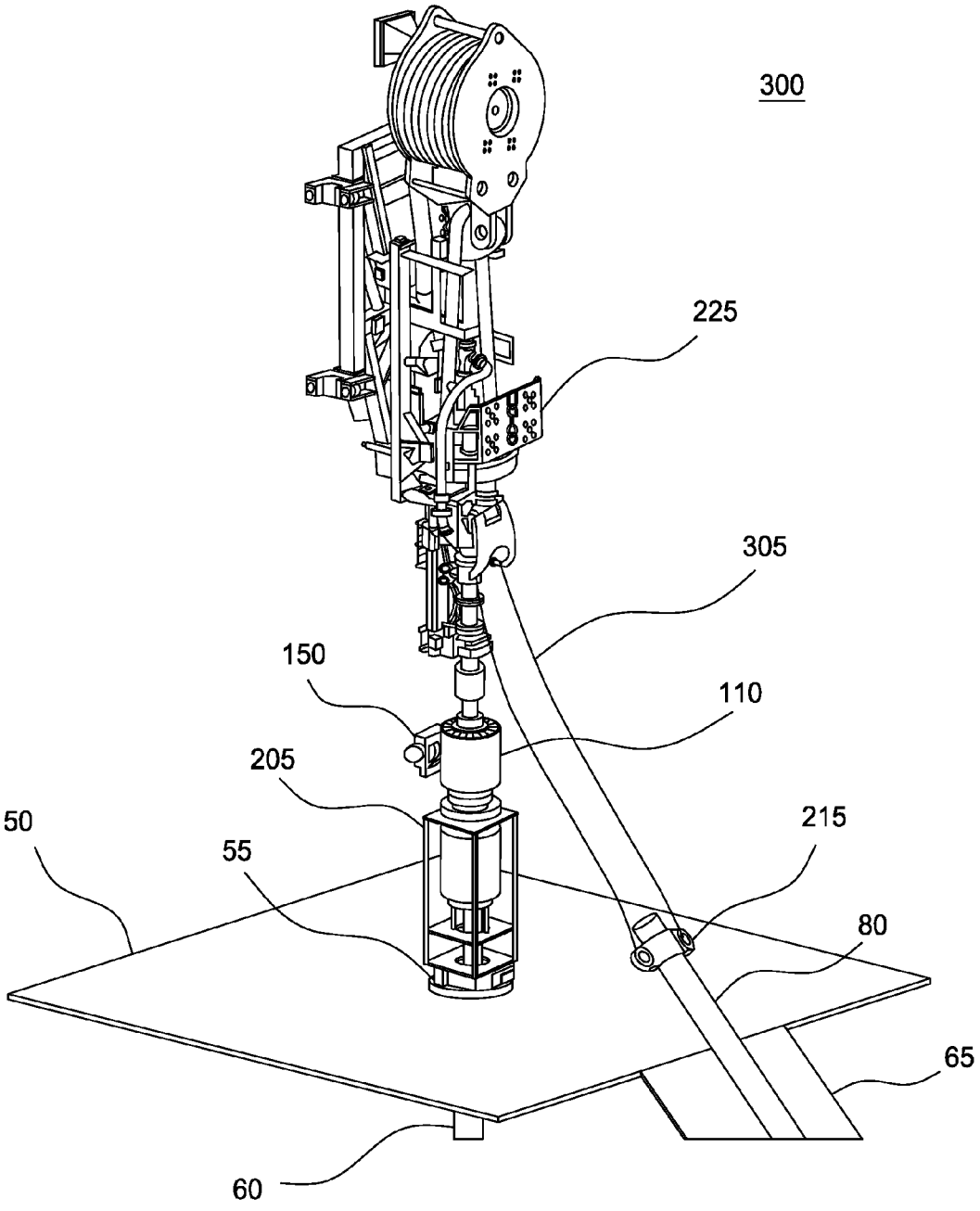
FIG. 28 illustrates another embodiment of the pipe handling system.

FIG. 28 illustrates the elevator 215 being positioned adjacent the pipe joint 80. It is to be noted that the elevator 215 is connected to the top drive assembly 225 via wire rope 305. The wire rope 305 may be winched up and down to assist with the joining operation. As such, the top drive assembly 225 would not require the use of the link-tilt device. As also shown in FIG. 28, the pipe handling system 300 includes the internal gripping tool 110. The internal gripping tool 110 is connected to the top drive assembly 225. Further, the internal gripping tool 110 is configured to hold the string of pipe 60 and position the string of pipe 60 after the joining (e.g. welding or forging) operation is completed as will be described herein. Further, a stop facility on the internal gripping tool 110 may be used to permit accurate juxtaposition of the various components in the system, such as the pipe joint. Since the internal gripping tool 110 is configured to support the weight of the string of pipe 60, the elevator 215 in the pipe handling system 300 may be a single joint elevator with or without a slip arrangement.

Figure 29:
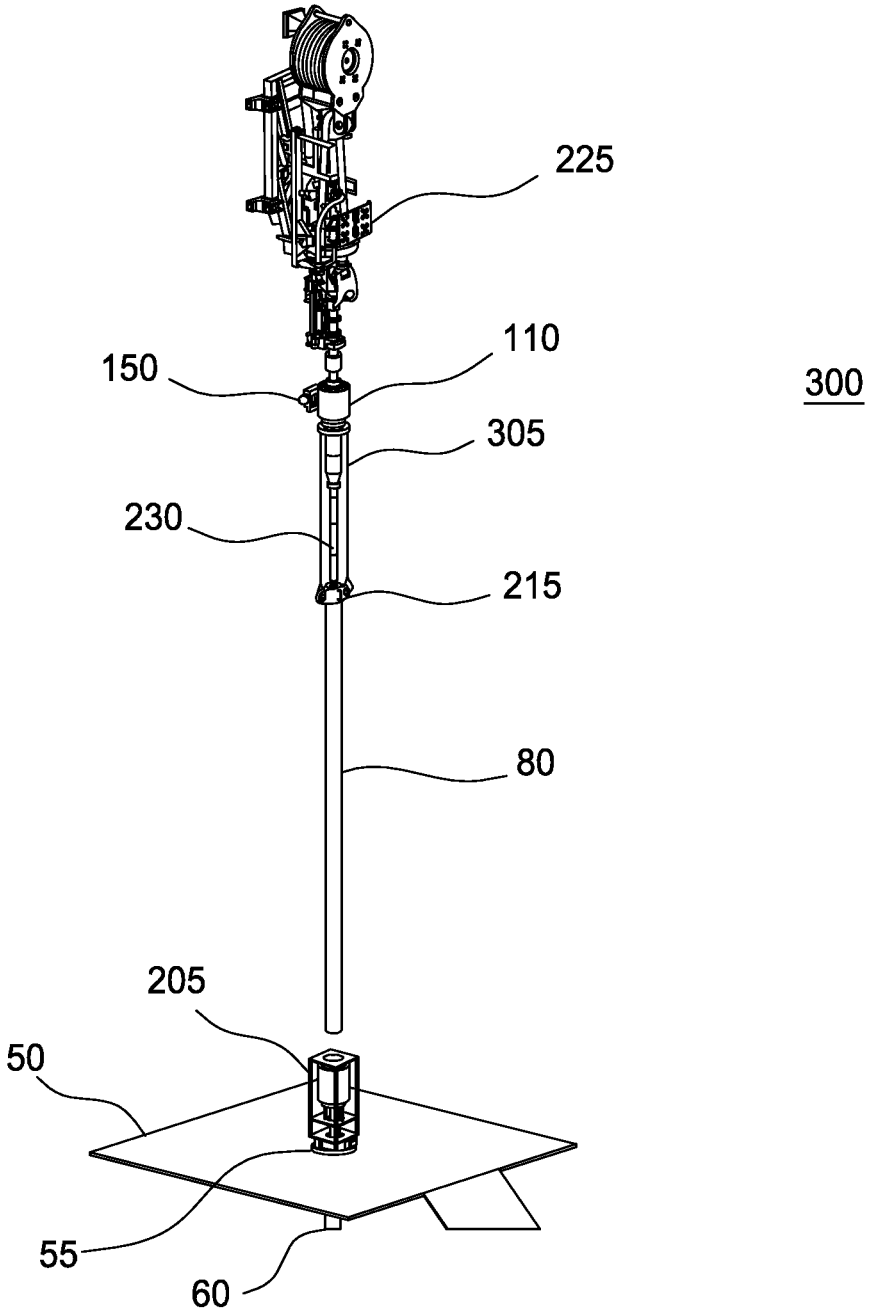
FIG. 29 illustrates an elevator supporting a pipe joint after the pipe joint has been lifted from a pipe ramp.

FIG. 29 illustrates the elevator 215 supporting the pipe joint 80 after the pipe joint 80 has been lifted from the pipe ramp 65. As shown in FIG. 29, the winch device 150 is mounted to the side of the internal gripping tool 110. In this arrangement, the parked position of the internal joining tool 230 would be above the elevator 215 and below the internal gripping tool 110 so as to not interfere with the handling of the pipe joint 80. Additionally, the winch device 150 may be remotely controlled to position the internal joining tool 230.

Figure 30B:
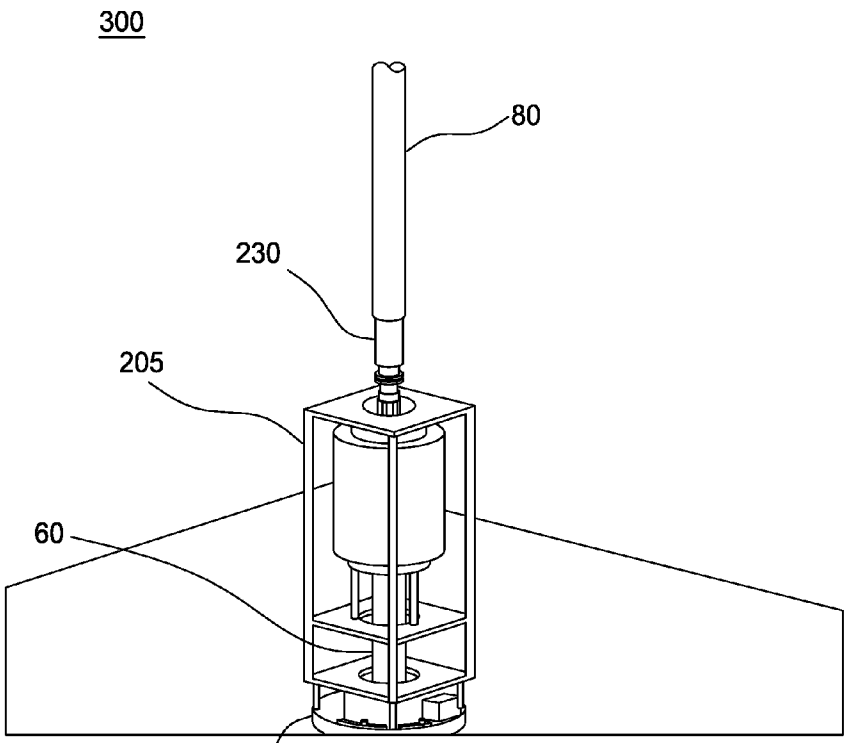
FIGS. 30A and 30B illustrate the positioning of an internal joining tool in a weld position.
Figure 30A:
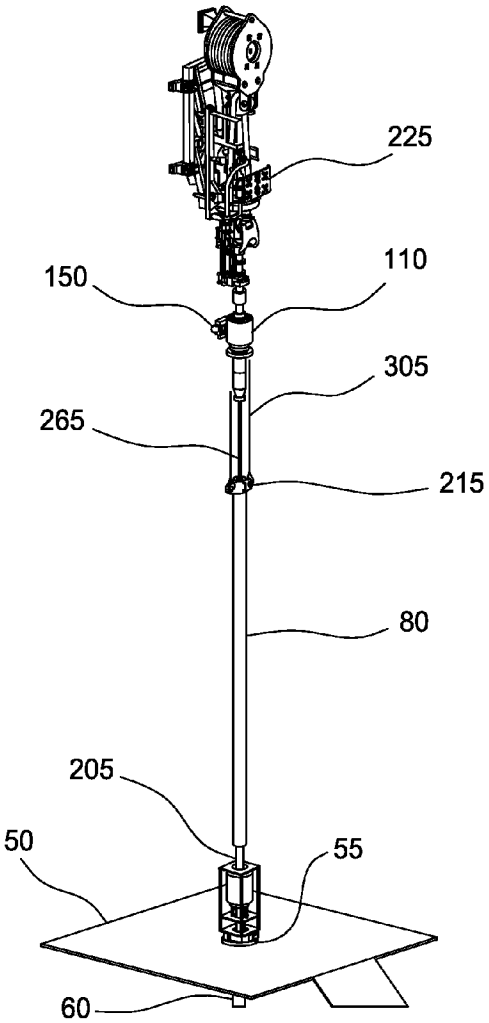

FIGS. 30A and 30B illustrate the positioning of the internal joining tool 230 to the weld position within the pipe joint 80. After the pipe joint 80 is positioned relative to the string of pipe 60, the internal joining tool 230 is lowered into the pipe joint 80 by activating the winch device 150 and releasing the umbilical cable 265, as shown in FIG. 30A. The internal joining tool 230 is lowered until a portion of the internal joining tool 230 is positioned within the pipe joint 80 and the string of pipe 60, as shown in FIG. 30B. At this point, a flaring device in the internal joining tool 230 may be activated to flare out a lower end of the pipe joint 80 and an upper end of the string of pipe 60 if not pre-flared.

Figure 31B:
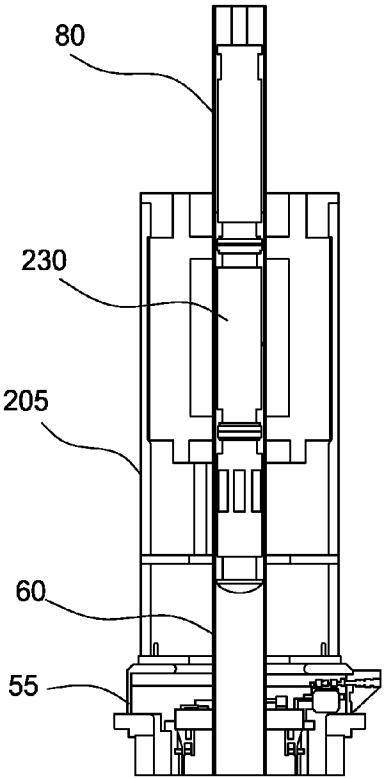
FIGS. 31A and 31B illustrate an end of the pipe joint being positioned adjacent a string of pipe.
Figure 31A:
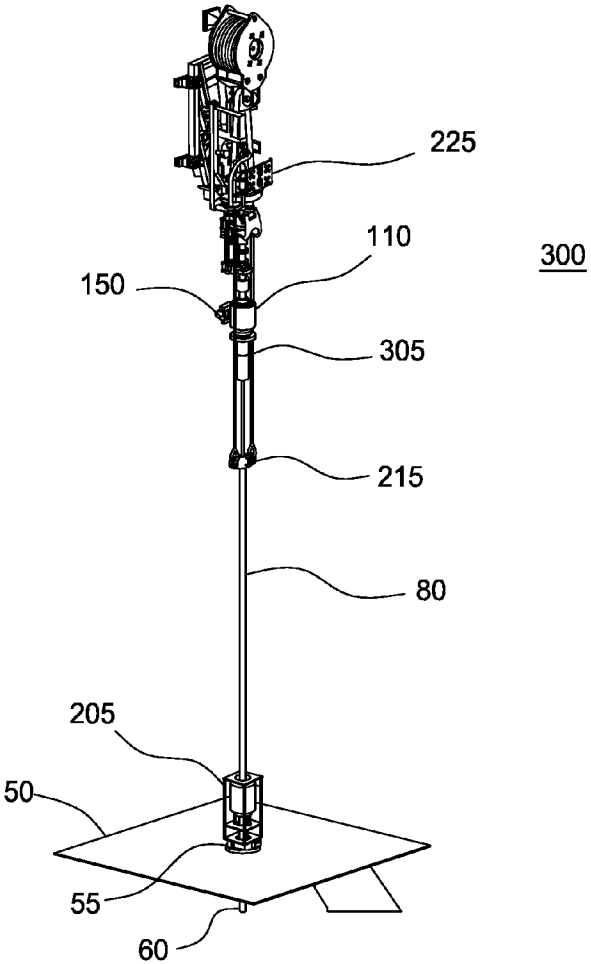

FIGS. 31A and 31B illustrate the end of the pipe joint 80 positioned adjacent the end of the string of pipe 60. After the ends of the pipes are flared, the top drive 225 lowers the pipe joint 80 into the external joining tool 205 until the end of the pipe joint 80 is proximate the end of the string of pipe 60. As shown in FIG. 31B, the internal joining tool 230 is in the weld position within the pipe joint 80 and the string of pipe 60. During the joining operation, the internal joining tool 230 may be used to position the pipe joints by moving the pipe joint 80 toward the string of pipe 60 such that the ends of the pipe joints are spaced apart by a predetermined distance or the ends are in contact with each other. When the internal joining tool 230 positions the pipe joint 80 for the joining operation, the slips of the elevator 215 may be opened to accommodate the pipe movement and/or a compensator may be attached to the top drive assembly 225, the elevator 215, etc. to accommodate the pipe movement. The internal joining tool 230 may also prepare the joining area around the connection point. Thereafter, the joining (e.g. welding or forging) operation is performed by the internal joining tool 230 and the external joining tool 205, and the pipe joint 80 becomes part of the string of pipe 60. The joining operation is concluded by verifying the integrity of the joint made.

Figure 32B:
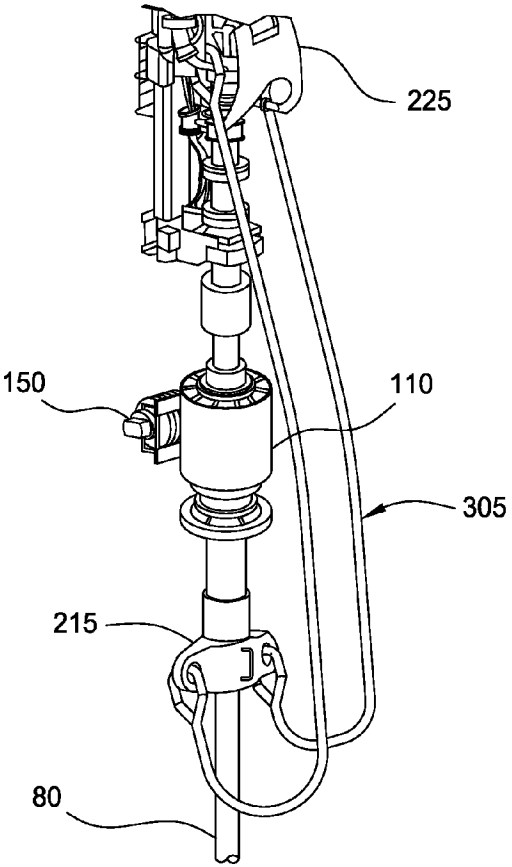
FIGS. 32A and 32B illustrate the positioning of an internal gripping tool.
Figure 32A:
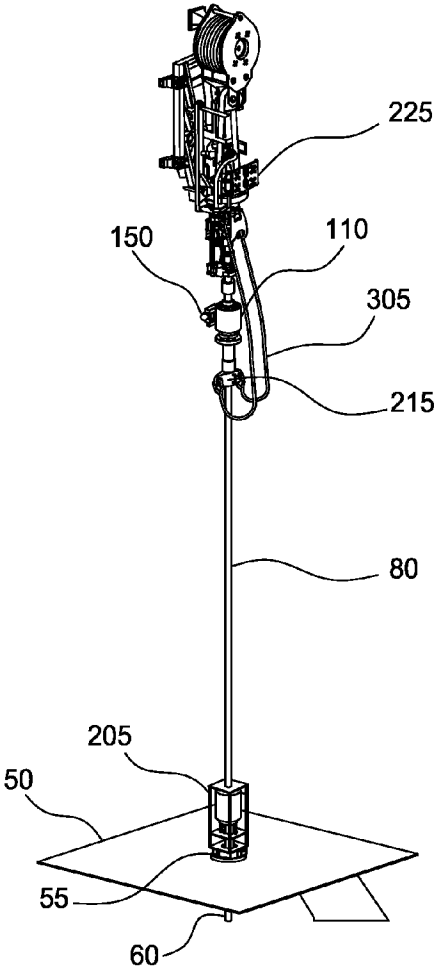

FIGS. 32A and 32B illustrate the positioning of the internal gripping tool 110. After the joining operation is complete, the top drive 225 is lowered until the internal gripping tool 110 is positioned on top of the pipe joint 80 as shown in FIG. 32A. In one embodiment, the internal gripping tool 110 includes a stop member that is configured to position the pipe joint 80 in the correct location for the engagement. Thereafter, the slips of the internal gripping tool 110 are activated. The winch device 150 would then retract the internal joining tool 230 to the parked position. With the internal gripping tool 110 engaged and the internal joining tool 230 positioned in the parked position, the internal gripping tool 110 can take the weight of the string of pipe 60 so the spider 55 can be opened.

Figure 34:
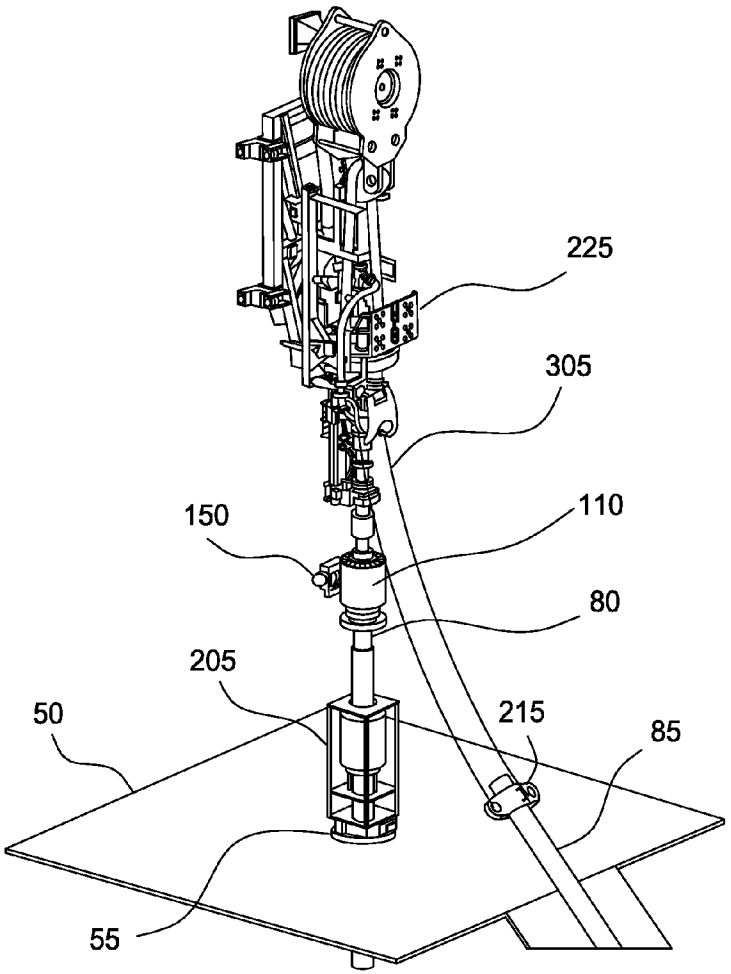
FIG. 34 illustrates the elevator attached to a second pipe joint.
Figure 33:
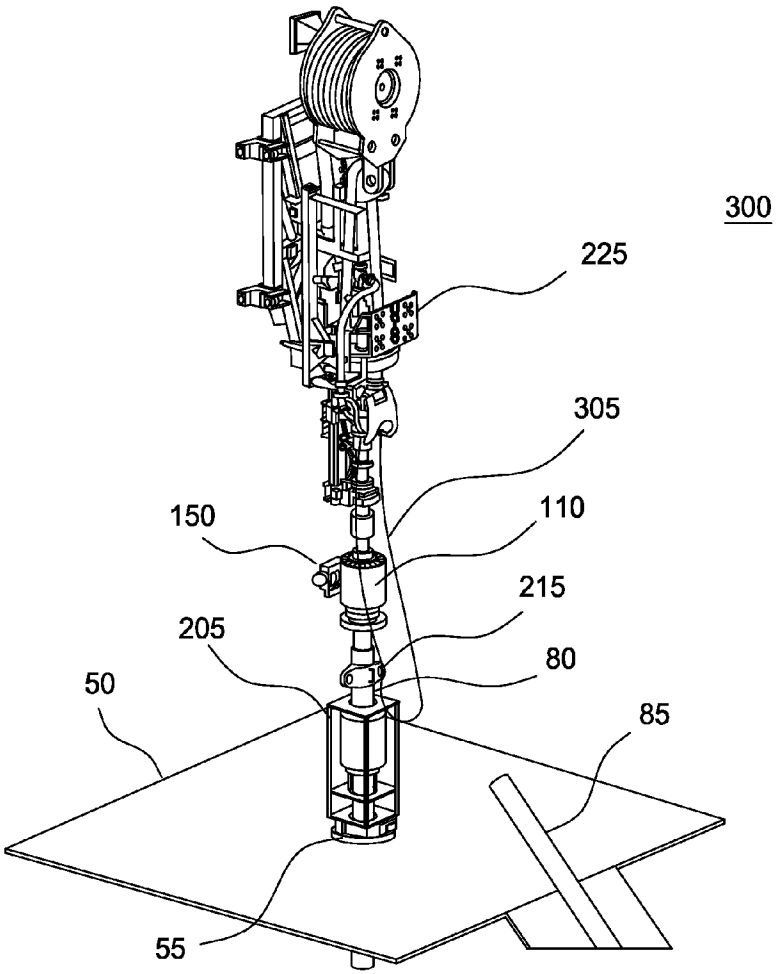
FIG. 33 illustrates the lowering of the string of pipe into the wellbore.
Figure 35:
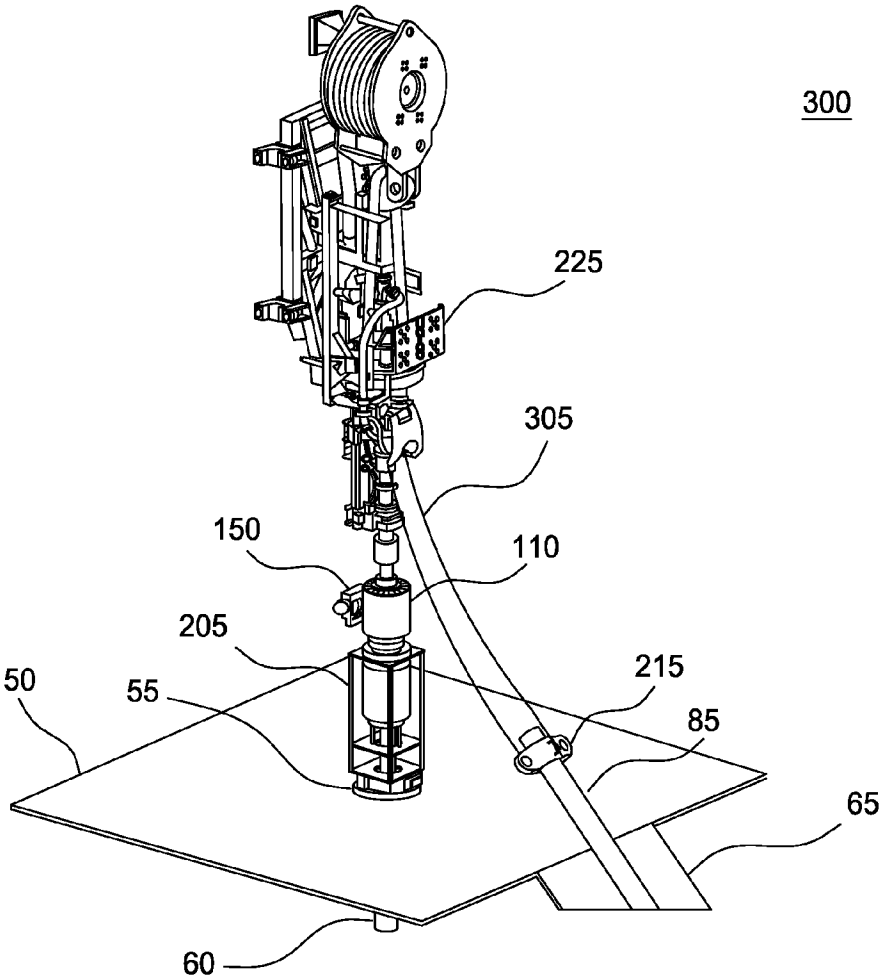
FIG. 35 illustrates the positioning of the string of pipe in an external joining tool.

FIG. 33 illustrates the lowering of the string of pipe 60 into the wellbore. The string of pipe 60 would then be lowered by the top drive 225 until the internal gripping tool 110 is right above the external joining tool 205. The elevator 215 may be released from the pipe joint 80 and positioned to retrieve the next pipe joint 85 from the pipe ramp 65, as shown in FIG. 34. FIG. 35 illustrates the positioning of the string of pipe 60 in the external joining tool 205. The string of pipe 60 is further lowered until an end of the string of pipe 60 is positioned proximate the center of the external joining tool 205. This position may be achieved by a physical stop between the internal gripping tool 110 and a top of the external joining tool 205. At this point, the spider 55 would then re-take the weight of the string of pipe 60 to allow the internal gripping tool 110 to disengage and this process would continue until all joints have been run into the wellbore.

FIGS. 36-42 illustrate a pipe handling system 400 for use with a joining assembly comprising the external joining tool 205 and an internal joining tool assembly 420. For convenience, the components in the pipe handling system 400 that are similar to the components in the pipe handling systems 100, 200, 300 will be labeled with the same number indicator.

Figure 36:
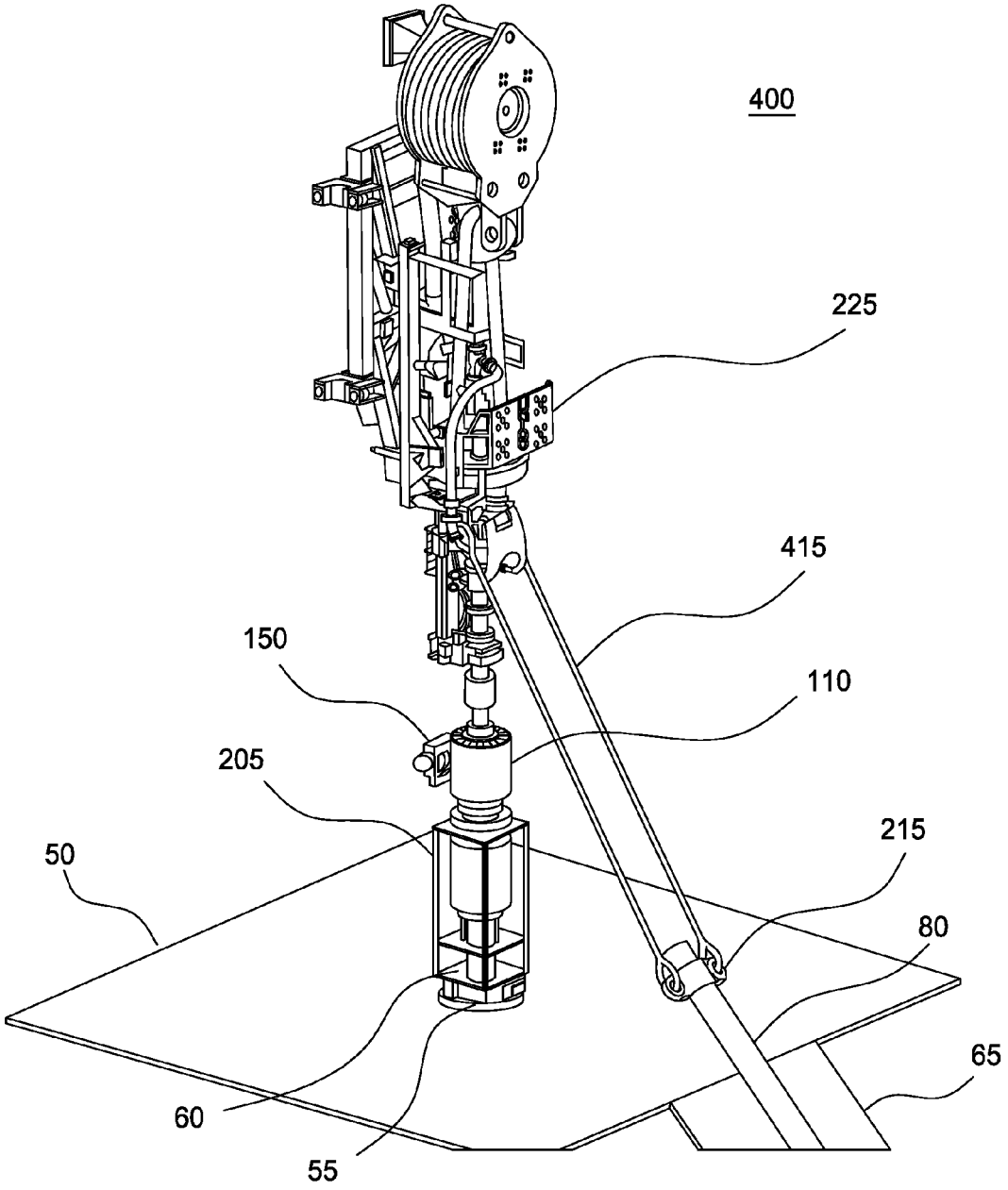
FIG. 36 illustrates another embodiment of the pipe handling system.

FIG. 36 illustrates the elevator 215 being positioned adjacent the pipe joint 80. As shown, the elevator 215 is positioned adjacent the pipe joint 80 by adjusting the location of bails 415 by utilizing the link-tilt device in the top drive 225. The link-tilt device may be activated by use of an appropriate piston-cylinder arrangement. As also shown in FIG. 36, the pipe handling system 400 includes the internal gripping tool 110 configured to hold the string of pipe 60 and position the string of pipe 60 after the joining operation is completed. As such, the elevator 215 in the pipe handling system 400 may be a single joint elevator with or without a slip arrangement. Further, the operation of the slips in the elevator 215 may be configured to be controlled by a remote device.

Figure 37:
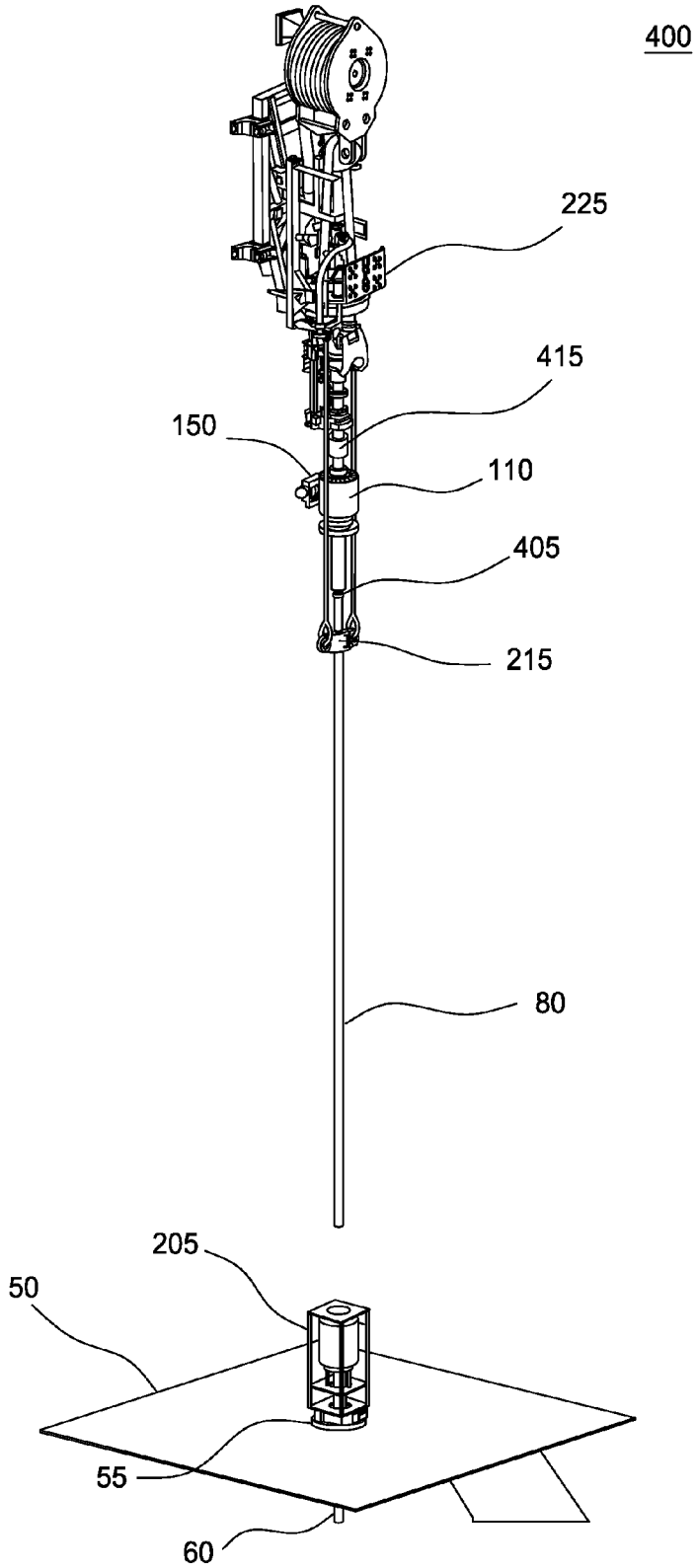
FIG. 37 illustrates an elevator supporting a pipe joint after the pipe joint has been lifted from a pipe ramp.

FIG. 37 illustrates the elevator 215 supporting the pipe joint 80 after the pipe joint 80 has been lifted from the pipe ramp 65. As shown in FIG. 37, the winch device 150 is mounted to the side of the internal gripping tool 110. In this embodiment, the winch device 150 is used to position a grappling device 405, such as an overshot tool, between a parked position and a connection position. In this arrangement, the parked position of the grappling device 405 would be above the elevator 215 and below the internal gripping tool 110 as to not interfere with the handling of the pipe joint 80. The grappling device 405 would also have accommodations to run hydraulic lines to the internal joining tool assembly 420 through quick connect fittings in order to operate the internal joining tool assembly 420. Additionally, the winch device 150 may be remotely controlled to position the grappling device 405.

Figure 38:
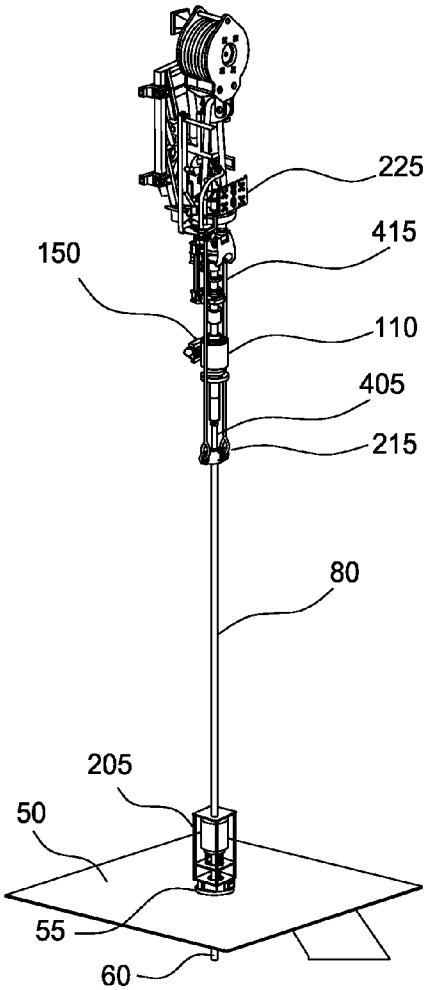
FIG. 38 illustrates an end of the pipe joint being positioned adjacent an end of a string of pipe.

FIG. 38 illustrates the end of the pipe joint 80 being positioned adjacent the end of the string of pipe 60. After the ends of the pipes are flared, the top drive 225 lowers the pipe joint 80 into the external joining tool 205 until the end of the pipe joint 80 is proximate the end of the string of pipe 60.

Figure 39:
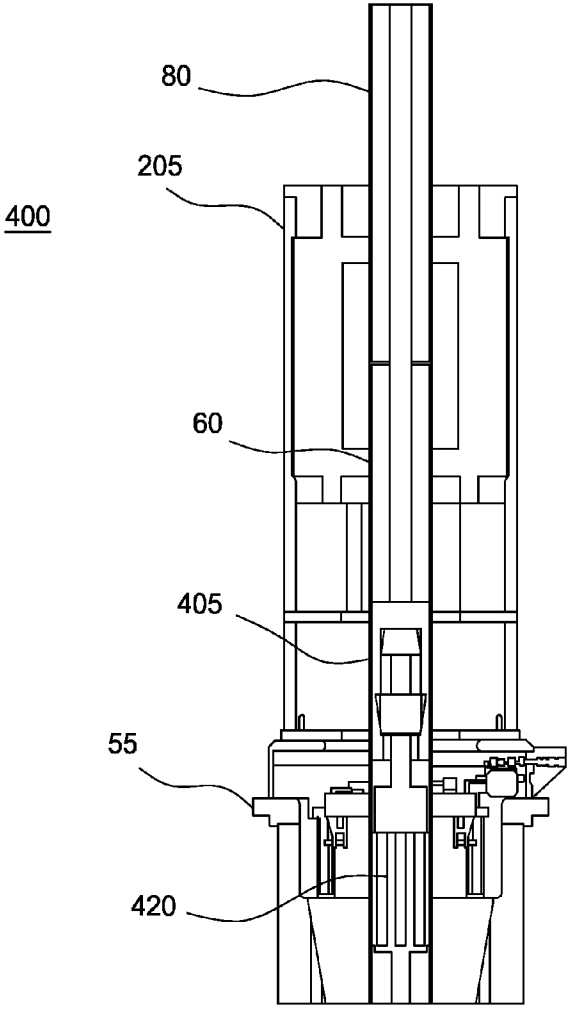
FIG. 39 illustrates the positioning of an internal joining tool assembly in the weld position.
Figure 40B:
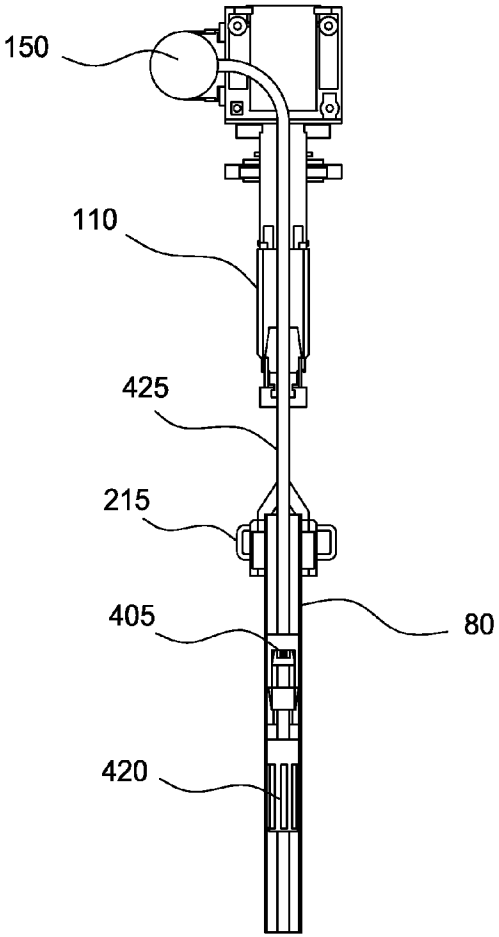
FIGS. 40A and 40B illustrate connecting the pipe joint to the string of pipe.
Figure 40A:
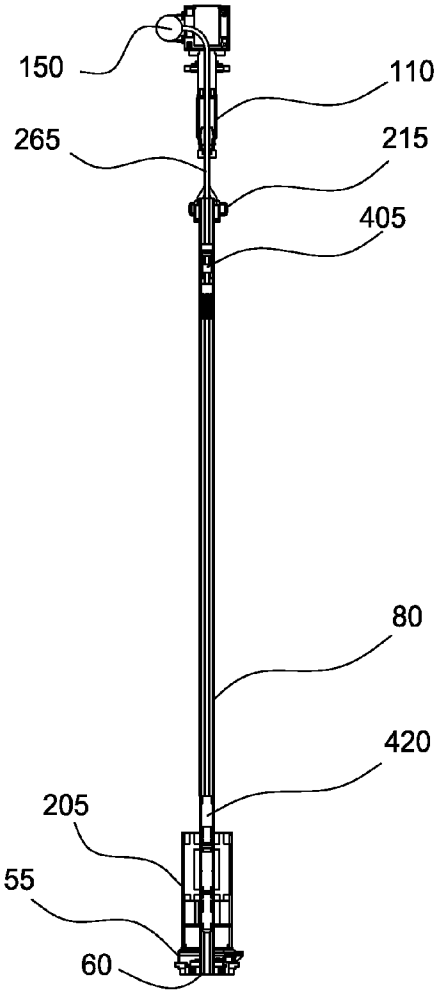

FIG. 39 illustrates the positioning of the internal joining tool assembly 420 to the weld position. After the connection point between the pipe joint 80 and the string of pipe 60 is formed, the winch device 150 lowers the grappling device 405 into the pipe joint 80 and the string of pipe 60 until the grappling device 405 catches an end profile 435 of the internal joining tool assembly 420 (see FIG. 42). It is to be noted that the internal joining tool assembly 420 was positioned in the string of pipe 60 after the previous pipe joint was connected to the string of pipe 60. Upon connecting the grappling device 405 to the end profile 435, the hydraulic lines in the umbilical cable 265 are connected to an umbilical 425 in the internal joining tool assembly 420. Thereafter, slips 430 in the internal joining tool assembly 420 would release and the winch device 150 would spool the internal joining tool assembly 420 to the weld position between the pipe joint 80 and the string of pipe 60. During the joining operation, the internal joining tool 230 may be used to position the pipe joints by moving the pipe joint 80 toward the string of pipe 60 such that the ends of the pipe joints are spaced apart by a predetermined distance or the ends are in contact with each other. When the internal joining tool 230 positions the pipe joint 80 for the joining operation, the slips of the elevator 215 may be opened to accommodate the pipe movement and/or a compensator may be attached to the top drive assembly 225, the elevator 215, internal gripping tool 110, etc. to accommodate the pipe movement. The internal joining tool 230 may also prepare the joining area around the connection point. Thereafter, the joining (e.g. welding or forging) operation is performed by the internal joining tool 230 and the external joining tool 205, and the pipe joint 80 becomes part of the string of pipe 60 as shown in FIGS. 40A and 40B. The joining operation is concluded by verifying the integrity of the joint made.

Figure 41:
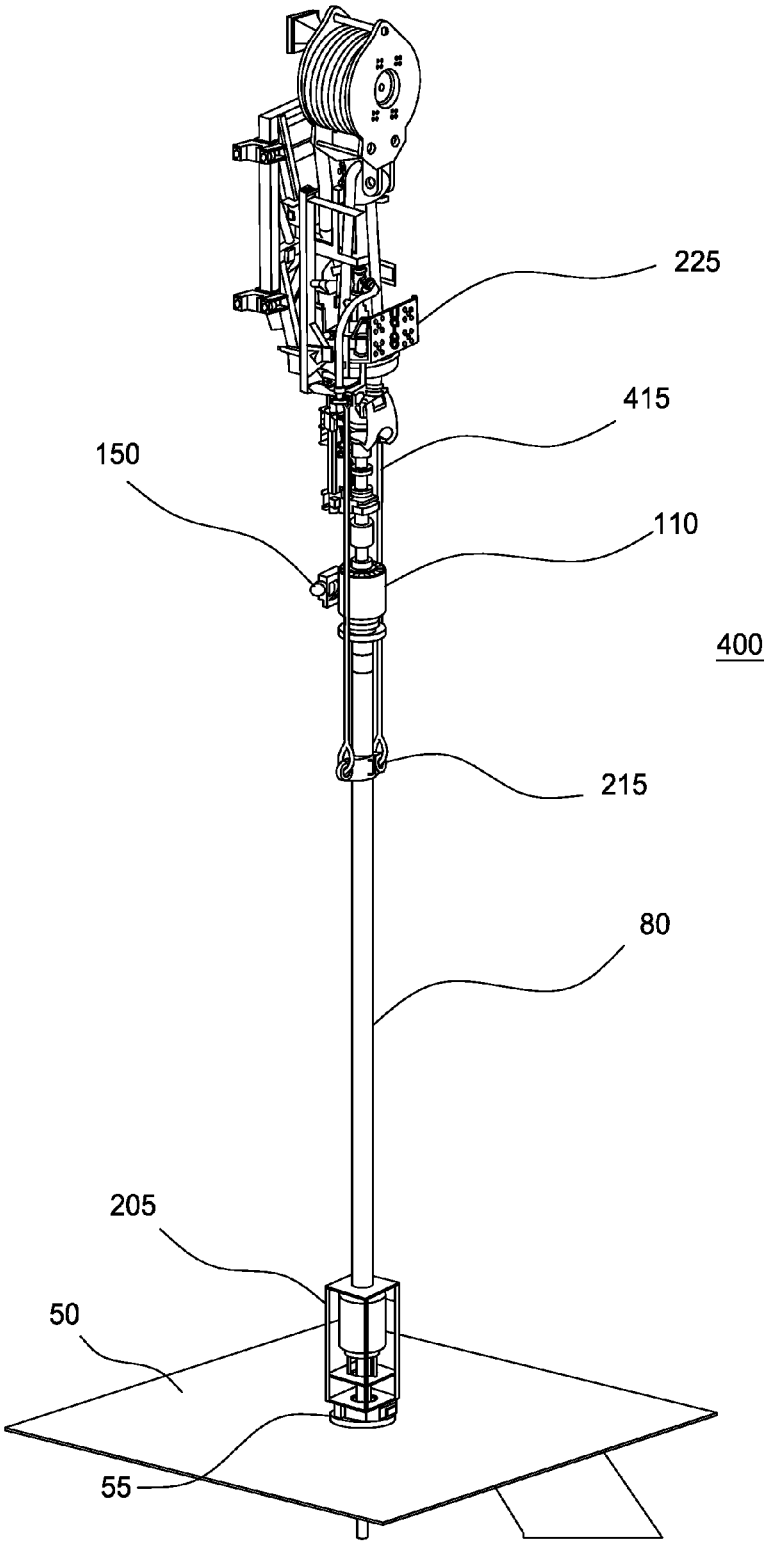
FIG. 41 illustrates the positioning of an internal gripping tool.
Figure 42:
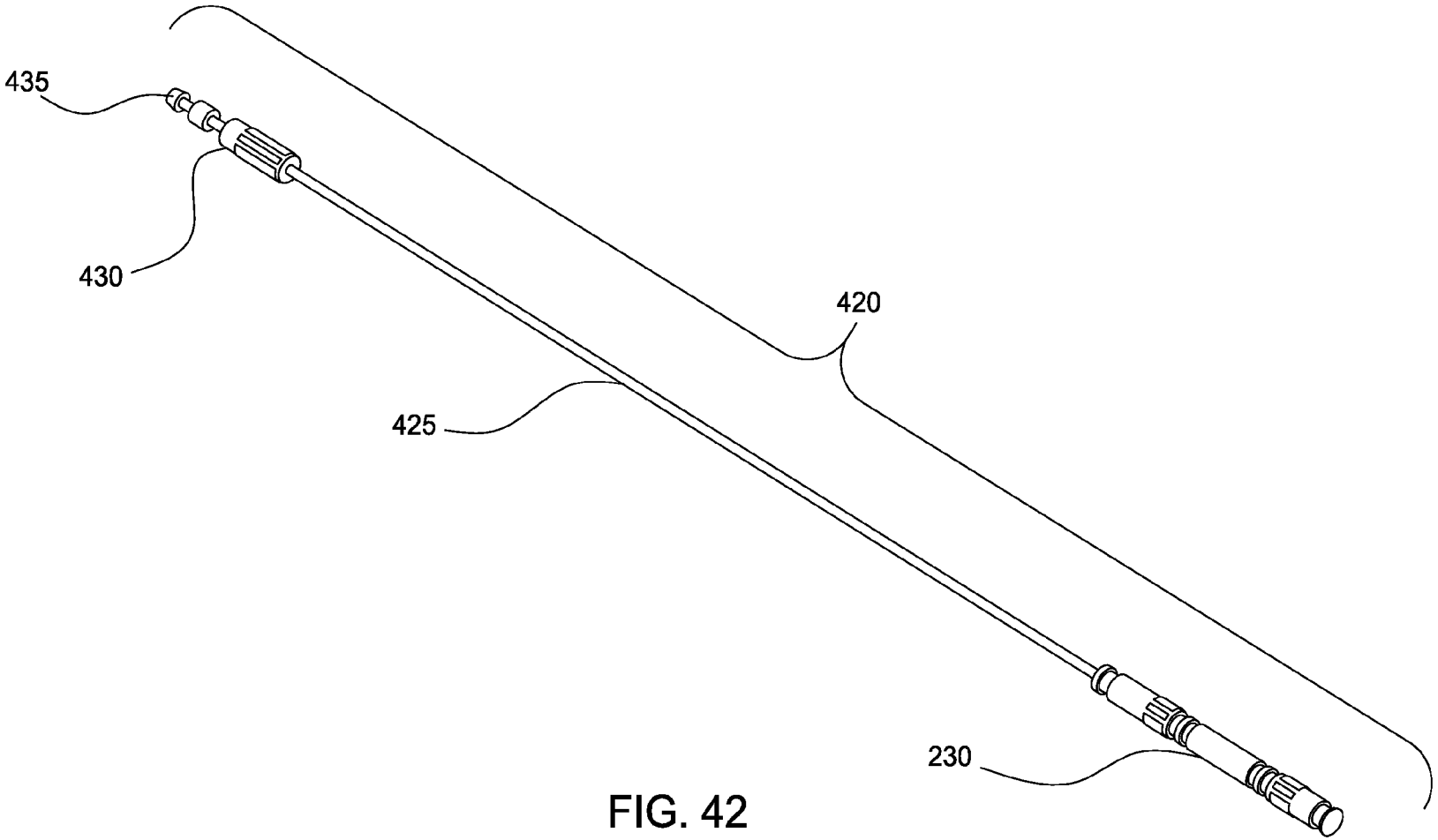
FIG. 42 illustrates an internal joining assembly.

FIG. 41 illustrates the positioning of the internal gripping tool 110. After the joining (e.g. welding or forging) operation is complete, the slips 430 would once again activate to secure the internal joining tool assembly 420 inside the string of pipe 60. The top drive 225 is then lowered until the internal gripping tool 110 is positioned on top of the pipe joint 80 as shown in FIG. 41. In one embodiment, the internal gripping tool 110 includes a stop member that is configured to position the pipe joint 80. Thereafter, the slips of the internal gripping tool 110 are activated. With the internal gripping tool 110 engaged, the internal gripping tool 110 can take the weight of the string of pipe 60 so the spider 55 can be opened. The string of pipe 60 would then be lowered by the top drive 225 until the internal gripping tool 110 is right above the external joining tool 205. The elevator 215 may be released from the pipe joint 80 and positioned to retrieve the next pipe joint from the pipe ramp 65. The string of pipe 60 is further lowered until an end of the string of pipe 60 is positioned proximate the center of the external joining tool 205. This position may be achieved by a physical stop between the internal gripping tool 110 and a top of the external joining tool 205. At this point, the spider 55 would then re-take the weight of the string of pipe 60 to allow the internal gripping tool 110 to disengage. The grappling device 405 would let go of the internal joining tool assembly 420 and the umbilical cable 265 would be spooled back on the winch device 150, which positions the grappling device 405 in the parked position. This process would continue until all joints have been run into the wellbore.

FIGS. 43-48 illustrate a pipe handling system 500 for use with a joining assembly. For convenience, the components in the pipe handling system 500 that are similar to the components in the pipe handling systems 100, 200, 300, 400 will be labeled with the same number indicator.

Figure 43:
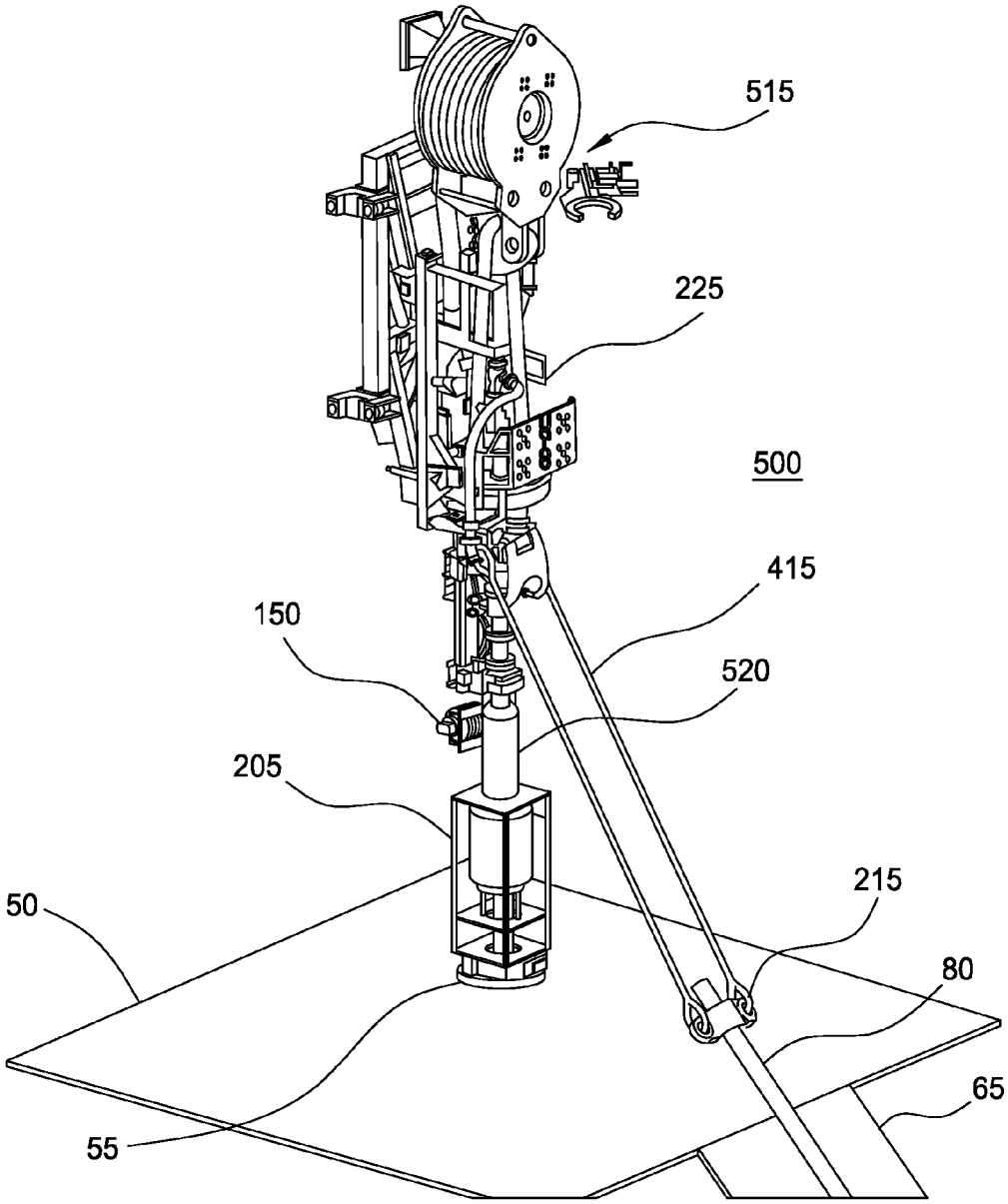
FIG. 43 illustrates another embodiment of the pipe handling system.

FIG. 43 illustrates the elevator 215 being positioned to pick up the pipe joint 80. As shown, the elevator 215 is positioned adjacent the pipe joint 80 by adjusting the location of the bails 415 by utilizing the link-tilt device in the top drive 225. The link-tilt device may be activated by use of an appropriate piston-cylinder arrangement. As also shown in FIG. 43, the pipe handling system 500 includes a releasable grabbing mechanism 520, similar to an overshot tool except that the releasable grabbing mechanism 520 is rigidly attached to the top drive 225. The releasable grabbing mechanism 520 is configured to grab and "lock-in" the internal joining tool 230 until the internal joining tool 230 is required to be deployed into the pipe joint 80 during the joining (e.g. welding or forging) operation. The releasable grabbing mechanism 520 may also include remote hydraulic power in order to release the internal joining tool 230. As shown in FIG. 43, the pipe handling system 500 further includes a remote controlled tubular manipulation arm 515 that can be used to guide the pipe joint 80 to the well center and to assist the guiding of the pipe joint 80 into the external joining tool 205. In another embodiment, the internal joining tool 230 may be used to pick up the pipe joint 80 in place of the elevator 215.

Figure 44B:
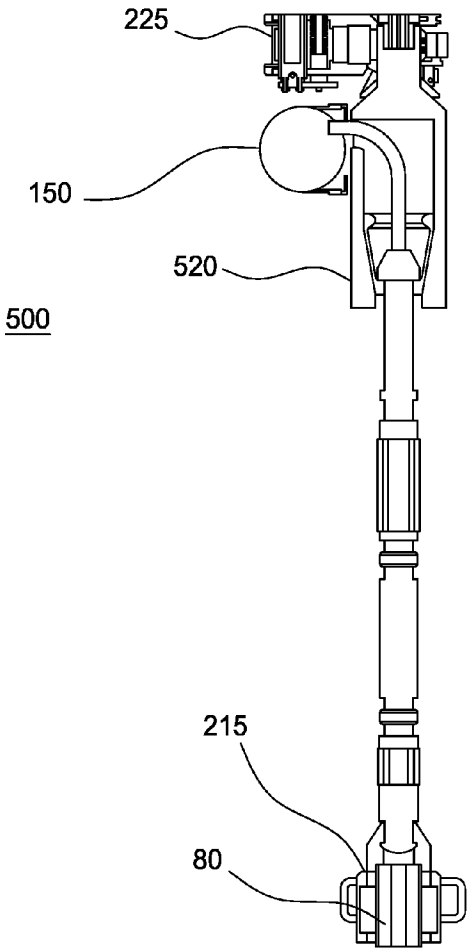
FIGS. 44A and 44B illustrate an elevator supporting a pipe joint.
Figure 44A:
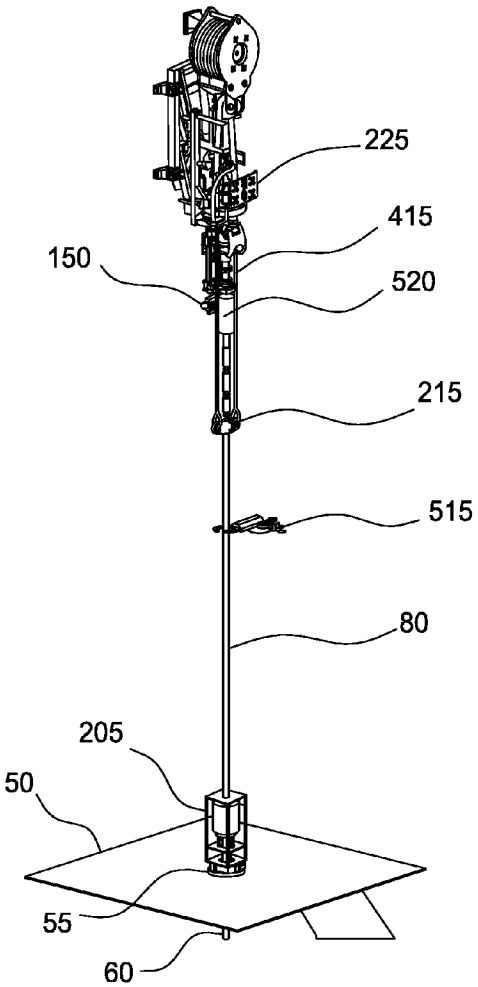

FIGS. 44A and 44B illustrate the elevator 215 supporting the pipe joint 80 after the pipe joint 80 has been lifted from the pipe ramp 65. As shown in FIG. 44A, the winch device 150 is mounted to the side of the grabbing mechanism 520. In this arrangement, the parked position of the internal joining tool 230 would be above the elevator 215 and locked into the grabbing mechanism 520 as to not interfere with the handling of the pipe joint 80. Additionally, the winch device 150 may be remotely controlled to position the internal joining tool 230.

Figures 45A, 45B, 45C:
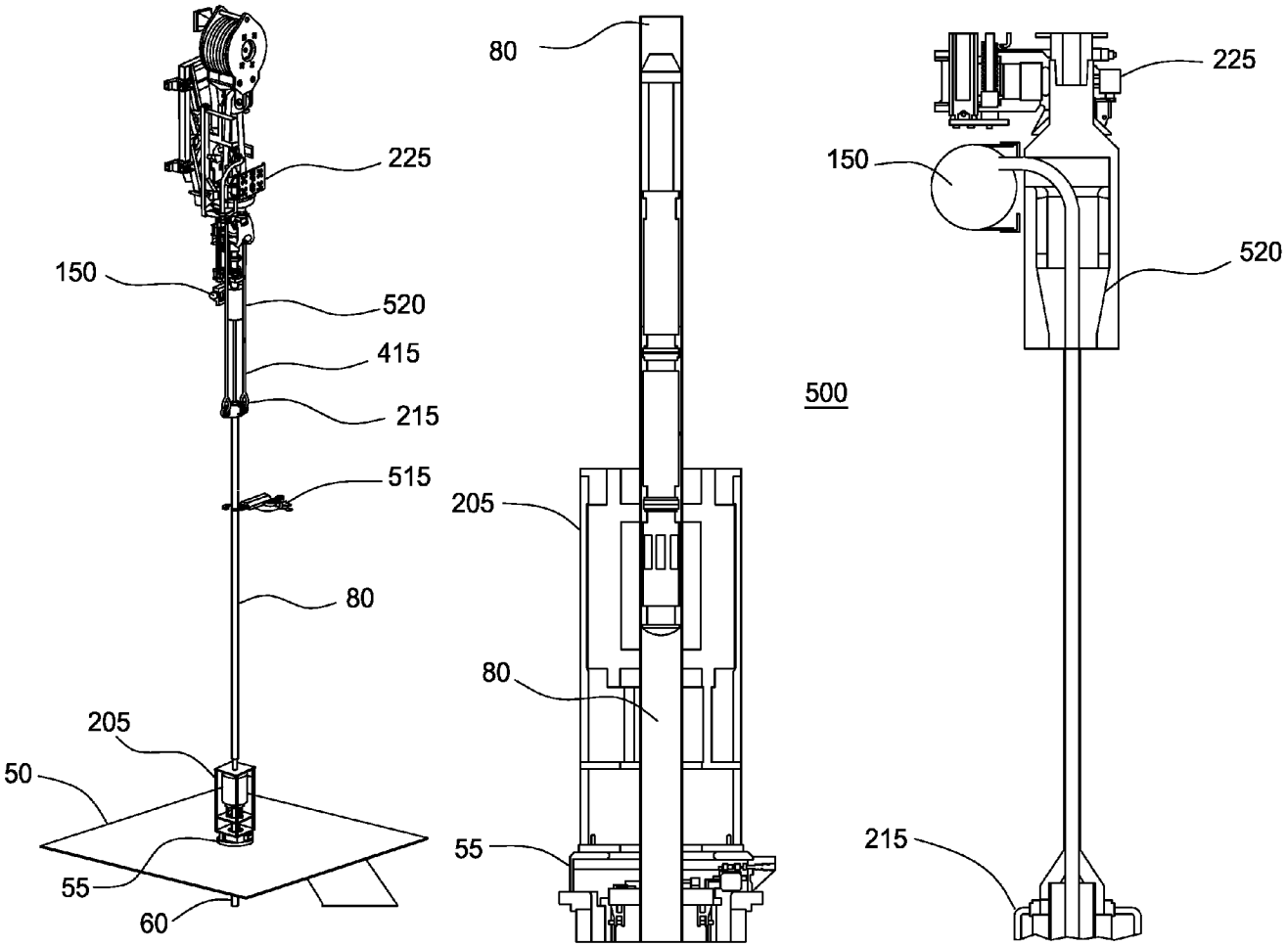
FIGS. 45A-45C illustrate the deployment of an internal joining tool.

FIGS. 45A-45C illustrate the deployment of the internal joining tool 230. After the elevator 215 supports the pipe joint 80, the grabbing mechanism 520 is activated to release the internal joining tool 230 into the pipe joint 80. The internal joining tool 230 is lowered into the pipe joint 80 by activating the winch device 150, as shown in FIG. 45C. The internal joining tool 230 is lowered until a portion of the internal joining tool 230 is positioned in the pipe joint 80 and the string of pipe 60, as shown in FIG. 45B. At this point, a flaring device in the internal joining tool 230 may be activated to flare out a lower end of the pipe joint 80 and an upper end of the string of pipe 60 if not pre-flared.

Figure 46B:
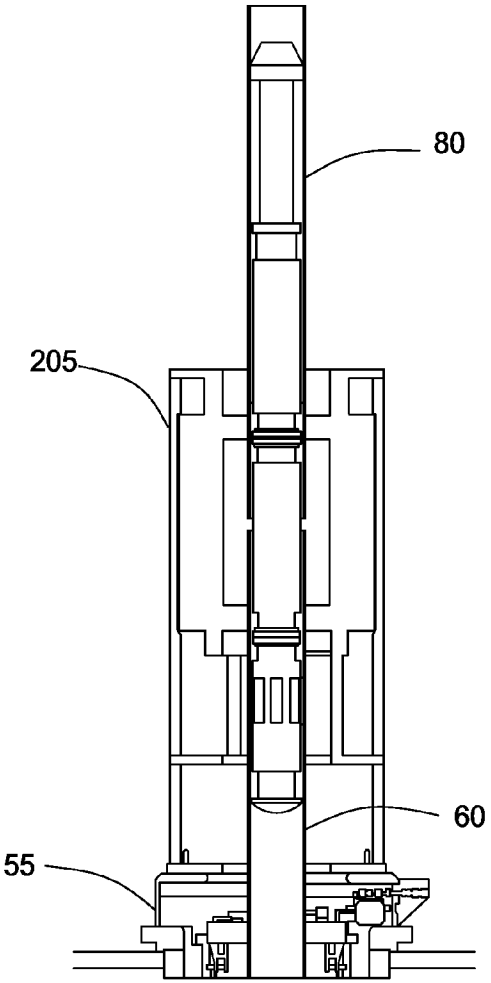
FIGS. 46A and 46B illustrate an end of the pipe joint disposed adjacent a string of pipe.
Figure 46A:
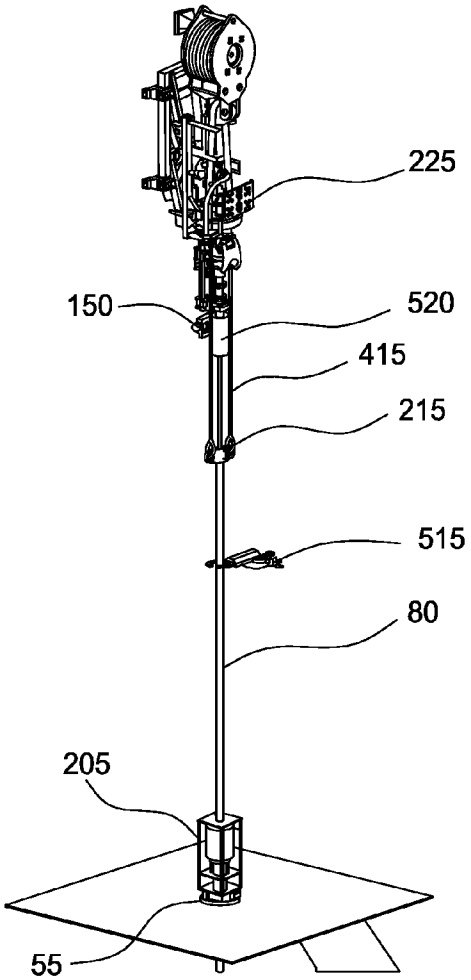

FIGS. 46A and 46B illustrate the end of the pipe joint 80 positioned adjacent the end of the string of pipe 60. After the ends of the pipes are flared, the top drive 225 lowers the pipe joint 80 into the external joining tool 205 until the end of the pipe joint 80 is proximate the end of the string of pipe 60. The remote controlled tubular manipulation arm 515 may be used to assist the positioning of the pipe joint 80 and the holding of the pipe joint 80. It is to be noted that the remote controlled tubular manipulation arm 515 may be used in any embodiment described herein.

As shown in FIG. 46B, the internal joining tool 230 is in the weld position within the pipe joint 80 and the string of pipe 60. During the joining operation, the internal joining tool 230 may be used to position the pipe joints by moving the pipe joint 80 toward the string of pipe 60 such that the ends of the pipe joints are spaced apart by a predetermined distance or the ends are in contact with each other. When the internal joining tool 230 positions the pipe joint 80 for the joining operation, the slips of the elevator 215 may be opened to accommodate the pipe movement and/or a compensator may be attached to the top drive assembly 225, the elevator 215, internal gripping tool 110, etc. to accommodate the pipe movement. The internal joining tool 230 may also prepare the joining area around the connection point. Thereafter, the joining (e.g. welding or forging) operation is performed by the internal joining tool 230 and the external joining tool 205, and the pipe joint 80 becomes part of the string of pipe 60. The joining operation is concluded by verifying the integrity of the joint made.

Figure 47B:
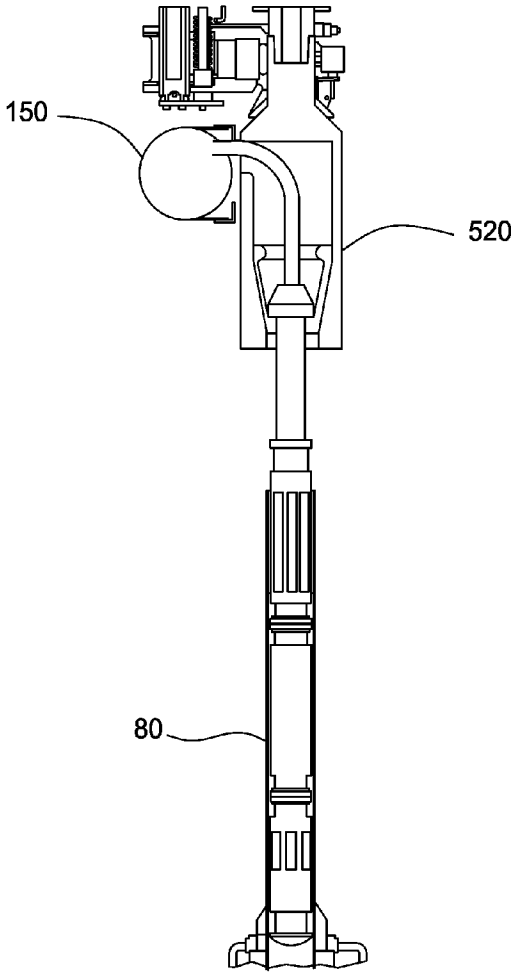
FIGS. 47A and 47B illustrate the positioning of an internal joining tool in a grabbing mechanism.
Figure 47A:
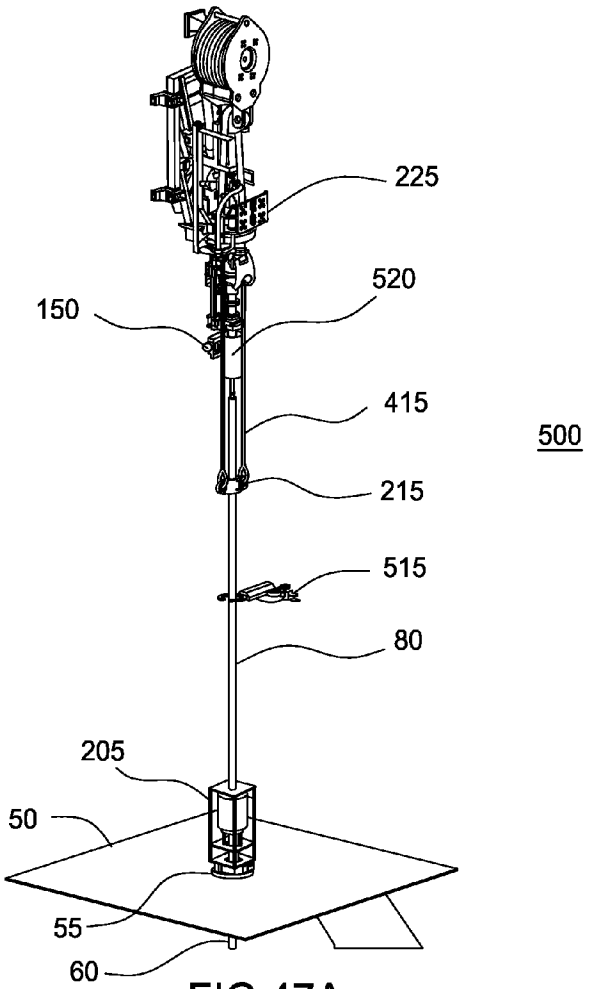

FIGS. 47A and 47B illustrate the positioning of the internal joining tool 230 in the grabbing mechanism 520. After the joining operation is complete, the winch device 150 retracts the internal joining tool 230 to the parked position in order to lock the internal joining tool 230 in the grabbing mechanism 520. At this point, the slips in the elevator 215 are released and the top drive 225 is lowered until the top slips of the internal joining tool 230 align with the top of the pipe joint 80, as shown in FIG. 47B. Thereafter, the slips in the internal joining tool 230 activate and engage the pipe joint 80. With the internal joining tool 230 engaged in the pipe joint 80, the internal joining tool 230 can take the weight of the string of pipe 60 so the spider 55 can be opened.

Figure 48B:
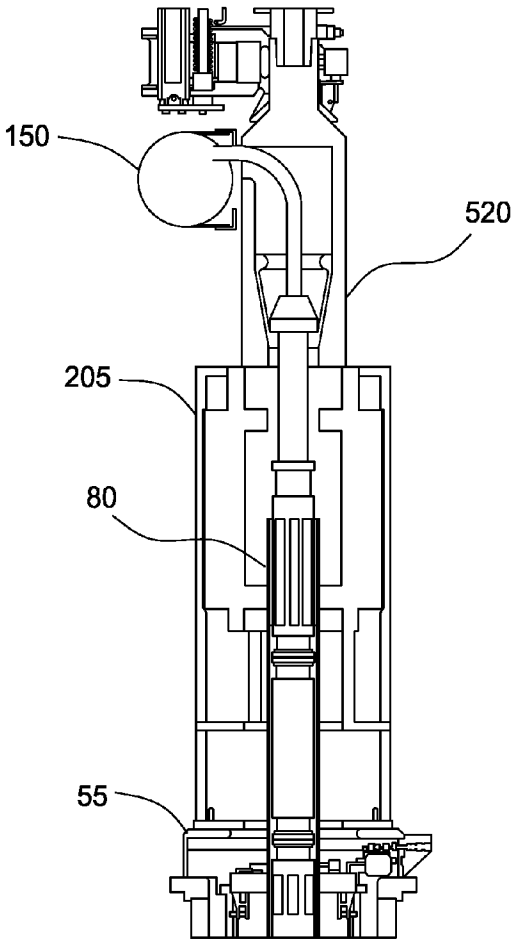
FIGS. 48A and 48B illustrate the lowering of the string of pipe into a wellbore.
Figure 48A:
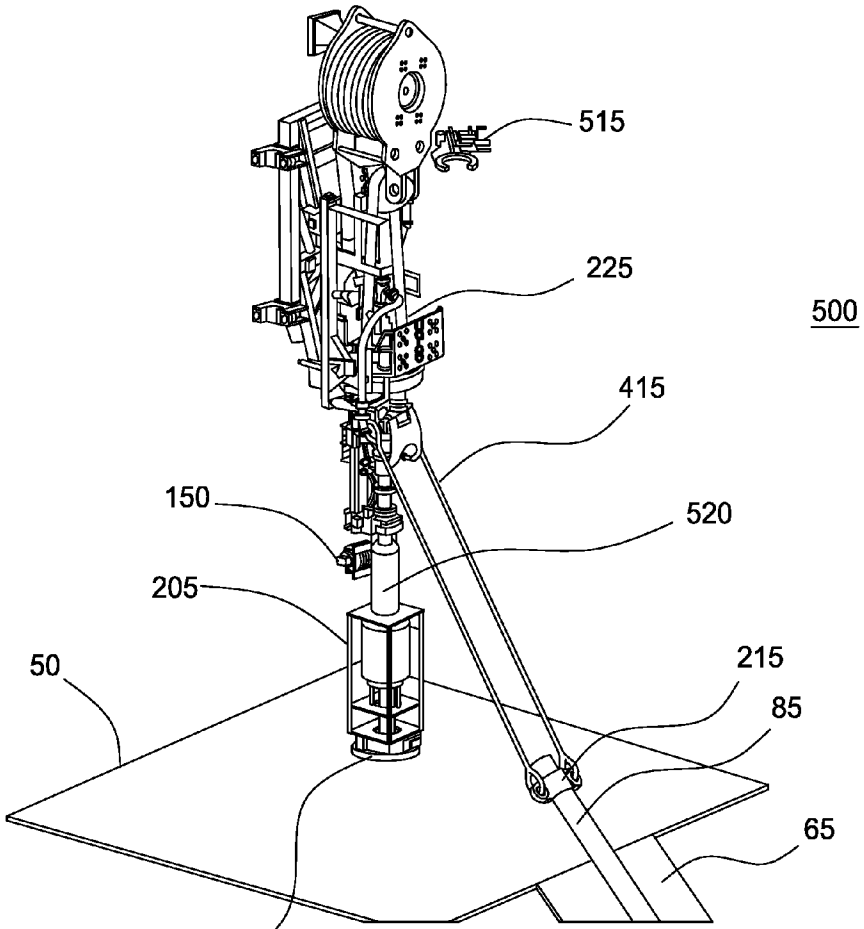

FIGS. 48A and 48B illustrate the lowering of the string of pipe 60 into the wellbore. The string of pipe 60 is lowered by the top drive 225 until the grabbing mechanism 520 is right above the external joining tool 205 and an end of the string of pipe 60 is positioned proximate the center of the external joining tool 205. This position may be achieved by a physical stop between the grabbing mechanism 520 and a top of the external joining tool 205. As this occurs, the link-tilt in the top drive 225 positions the elevator 215 toward the pipe ramp 65 in order to grip the next pipe joint 85. At this point, the spider 55 would then re-take the weight of the string of pipe 60 to allow the internal joining tool 230 to disengage. This process would continue until all joints have been run into the wellbore.

In one embodiment, a control system could be incorporated into a panel which is operated by a single person. For instance, an interlock system can be installed on the spider 55 and the elevator 215 to prevent dropped pipe string situations. Also, positional interlocks could be in place to prevent unwanted motion between the top drive 225, the internal joining tool 230, and the external joining tool 205. Additionally, communication may be maintained with other people at the well site either through an indicator box, mechanical and/or electrical interlocks, verbal/visual cues, or the entire system could be operated from a console, if desired.

In another embodiment, a positioning arm, such as a Stab Master™, may be used to stabilize the lower portion of each pipe joint as it is picked up of the pipe ramp or V-door. In a further embodiment, a funnel shaped guidance device may be used while lowering the pipe joint into the external joining tool 205. In yet a further embodiment, a funnel shaped guidance device may be used for inserting the internal joining tool 230 into the pipe joint. The funnel shaped guidance device may be configured to be removable from the pipe handling system so that it does not interfere with the running and positioning of pipe joint.

In another embodiment, a pipe handling assembly for connecting a pipe joint to a pipe string includes an internal joining tool for positioning inside a pipe joint; an external joining tool for positioning around the pipe string; a gripper configured to grip a surface of the pipe joint; an elevator configured to pick up the pipe joint and position the pipe joint adjacent a string of pipe disposed in the external joining tool; and a deployment assembly for positioning the internal joining tool inside the pipe joint.

In one or more of the embodiments described herein, the pipe handling assembly includes a link tilt device for moving the elevator.

In one or more of the embodiments described herein, the external joining tool is axially movable relative to the pipe string.

In one or more of the embodiments described herein, the internal joining tool includes a stop member.

In one or more of the embodiments described herein, the internal joining tool is configured to grip the pipe joint.

In one or more of the embodiments described herein, the internal joining tool is configured to seal and an annulus in the pie joint.

In one or more of the embodiments described herein, the internal joining tool is configured to flare an end of the pipe joint.

While the foregoing is directed to embodiments of the present invention, other and further embodiments of the invention may be devised without departing from the basic scope thereof, and the scope thereof is determined by the claims that follow.

The invention claimed is:

1. A pipe handling system for locating a pipe joint in a joining assembly that includes an internal joining tool and an external joining tool, the system comprising:

a gripper configured to grip a surface of the pipe joint;

an elevator configured to pick up the pipe joint and position the pipe joint adjacent a string of pipe disposed in the external joining tool; and a deployment assembly coupled to the gripper, wherein the deployment assembly includes a cable that is used to position the internal joining tool inside the pipe joint and configured to axially move the internal joining tool relative to the gripper.

2. The pipe handling system of claim 1, wherein the elevator includes a first door and a second door that are connected at one end by a hinge pin and connected at another end by a releasable pin.

3. The pipe handling system of claim 1, wherein the gripper includes a cable guide configured to guide the cable as the deployment assembly extends and retracts the cable.

4. The pipe handling system of claim 1, wherein the internal joining tool is positioned below the gripper.

5. The pipe handling system of claim 1, wherein the deployment assembly includes a grappling device attached to the cable, wherein the grappling device is configured to releasably engage the internal joining tool.

6. The pipe handling system of claim 5, wherein the grappling device is configured to operate the internal joining tool.

7. The pipe handling system of claim 6, wherein the grappling device is configured to operate a slip for attaching the internal joining tool to the pipe joint.

8. The pipe handling system of claim 1, wherein the deployment assembly includes a winch for extending or retracting the cable.

9. The pipe handling system of claim 1, wherein the cable is configured to supply power to the internal joining tool.

10. The pipe handling system of claim 1, wherein the gripper includes a stop member.

11. The pipe handling system of claim 1, further comprising a link tilt device for moving the elevator.

12. A pipe handling assembly for connecting a pipe joint to a pipe string, comprising:

an internal joining tool for positioning inside a pipe joint;

an external joining tool for positioning around the pipe string;

a gripper configured to grip a surface of the pipe joint;

an elevator configured to pick up the pipe joint and position the pipe joint adjacent a string of pipe disposed in the external joining tool; and a deployment assembly for positioning the internal joining tool inside the pipe joint and configured to axially move the internal joining tool relative to the gripper.

13. The pipe handling assembly of claim 12, wherein the gripper includes a cable guide configured to guide the cable as the deployment assembly extends and retracts the cable.

14. The pipe handling assembly of claim 12, wherein the deployment assembly positions the internal joining tool below the gripper and above the elevator.

15. The pipe handling assembly of claim 12, wherein the deployment assembly includes a grappling device attached to the cable, wherein the grappling device is configured to releasably engage the internal joining tool.

16. The pipe handling assembly of claim 15, wherein the grappling device is configured to operate the internal joining tool.

17. The pipe handling assembly of claim 16, wherein the grappling device is configured to operate a slip for attaching the internal joining tool to the pipe joint.

18. The pipe handling assembly of claim 12, wherein the deployment assembly includes a winch for extending or retracting the cable.

19. The pipe handling assembly of claim 12, wherein the cable is configured to supply power to the internal joining tool.

20. The pipe handling assembly of claim 12, wherein the gripper includes a stop member.

* * * * *